US009516443B2

(12) United States Patent
Risberg et al.

(10) Patent No.: US 9,516,443 B2
(45) Date of Patent: Dec. 6, 2016

(54) NON-LINEAR CONTROL OF LOUDSPEAKERS

(71) Applicant: Actiwave AB, Solna (SE)

(72) Inventors: Pär Gunnars Risberg, Solna (SE); Marcus Arvidsson, Linkoping (SE); Daniel Stahre, Stockholm (SE); Landy Toth, Newtown, PA (US)

(73) Assignee: CIRRUS LOGIC INTERNATIONAL SEMICONDUCTOR LTD., Edinburgh (GB)

( * ) Notice: Subject to any disclaimer, the term of this patent is extended or adjusted under 35 U.S.C. 154(b) by 0 days.

(21) Appl. No.: 14/405,273

(22) PCT Filed: Jun. 7, 2013

(86) PCT No.: PCT/IB2013/001533

§ 371 (c)(1),
(2) Date: Dec. 3, 2014

(87) PCT Pub. No.: WO2013/182901

PCT Pub. Date: Dec. 12, 2013

(65) Prior Publication Data

US 2015/0201294 A1 Jul. 16, 2015

Related U.S. Application Data

(60) Provisional application No. 61/656,676, filed on Jun. 7, 2012.

(51) Int. Cl.
*H04R 29/00* (2006.01)
*H04R 3/00* (2006.01)

(52) U.S. Cl.
CPC ..... *H04R 29/001* (2013.01); *H04R 3/002* (2013.01); *H04R 3/007* (2013.01); *H04R 29/003* (2013.01)

(58) Field of Classification Search
CPC ..... H04R 29/001; H04R 29/00
USPC ..... 381/59
See application file for complete search history.

(56) References Cited

U.S. PATENT DOCUMENTS 5,384,676 A * 1/1995 Yokoyama ..... G11B 5/588 360/77.13
6,058,195 A * 5/2000 Klippel ..... 381/150
2013/0259245 A1* 10/2013 Cheng ..... H04R 3/00 381/58

(Continued)

OTHER PUBLICATIONS

Jakobsson et al., "Modelling and Compensation of Nonlinear Loudspeaker", Sweden, Sep. 10, 2010, XP002713705, retrieved from the Internet: URL:http://publications.lib.chalmers.se/records/fulltext/126003.pdf, retrieved on Sep. 24, 2013, pp. 1-50.

(Continued)

*Primary Examiner* — Simon King
(74) *Attorney, Agent, or Firm* — Carter, DeLuca, Farrell & Schmidt, LLP

(57) ABSTRACT

A nonlinear control system is disclosed. More particularly, a nonlinear control system including a controller, an audio system, and a model is disclosed. The controller is configured to accept one or more input signals, and one or more estimated states produced by the model to produce one or more control signals. The audio system includes one or more transducers configured to accept the control signals to produce a rendered audio stream therefrom.

29 Claims, 6 Drawing Sheets

(56) References Cited

U.S. PATENT DOCUMENTS

2014/0233744 A1* 8/2014 Risberg ..... H03G 9/005
381/61

OTHER PUBLICATIONS

Klippel, "Active Compensation of Transducer Nonlinearities", AES 23rd International Conference, Copenhagen, Denmark, May 25, 2003, XP040374476, pp. 1-17.
International Search Report and Written Opinion issued in corresponding application No. PCT/IB2013/001533 on Oct. 11, 2013.

* cited by examiner

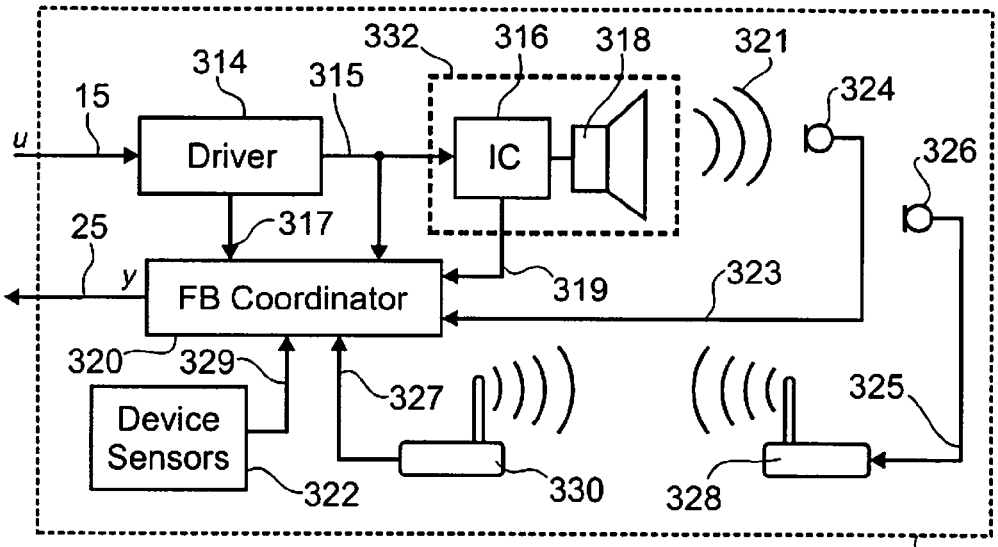
Fig 3b
Fig 3c
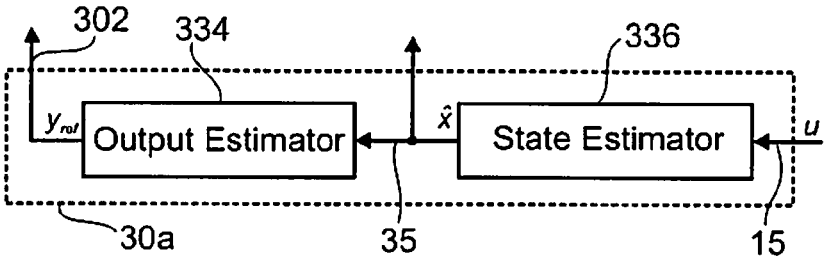
Fig 3d
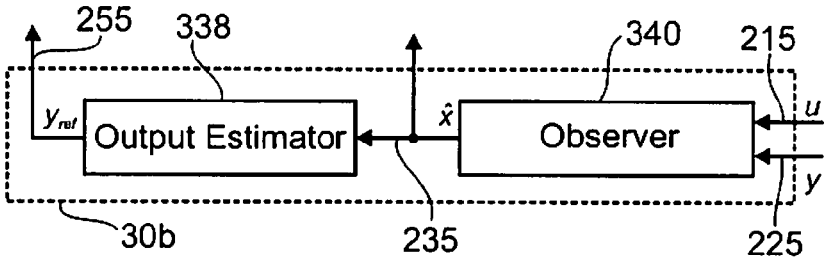
Fig 3e
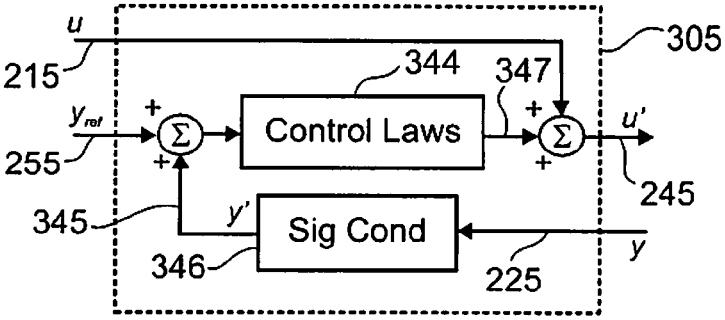

NON-LINEAR CONTROL OF LOUDSPEAKERS

CROSS-REFERENCE TO RELATED APPLICATION

The present application is a U.S. National Stage Application which claims the benefit of and priority to PCT International Application No. PCT/IB2013/001533 filed Jun. 7, 2013, which claims the benefit of and priority to U.S. Provisional Application Ser. No. 61/656,676 filed on Jun. 7, 2012, the entire contents of each of which are incorporated by reference herein for all purposes.

BACKGROUND

1. Technical Field

The present disclosure is directed to digital control of loudspeakers and particularly to nonlinear digital control systems for implementation in audio signal processing.

2. Background

Mobile technologies and consumer electronic devices (CED) continue to expand in use and scope throughout the world. In parallel with continued proliferation, there is rapid technical advance of device hardware and components, leading to increased computing capability and incorporation of new peripherals onboard a device along with reductions in device size, power consumption, etc. Most devices, such as mobile phones, tablets, and laptops, include audio communication systems and particularly one or more loudspeakers to interact with and/or stream audio data to a user.

Every device has an acoustic signature, meaning the audible characteristics of a device dictated by its makeup and design that influence the sound generated by the device or the way it interacts with sound. The acoustic signature may include a range of nonlinear aspects, which potentially depend on the design of the device, on the age of the device, the content of an associated stream (e.g. sound pressure level, spectrum, etc.), and/or the environment in which the device operates. The acoustic signature of the device may significantly influence the audio experience of a user.

Audio experience is one of many factors considered in the design of consumer electronic devices. Often, the quality of audio systems, loudspeakers, etc. are compromised in favor of other design factors such as cost, visual appeal, form factor, screen real-estate, case material selection, hardware layout, and assembly considerations amongst others.

Many of these competing factors are favored at the expense of the audio quality, as determined by the audio drivers, component layout, loudspeakers, material and assembly considerations, housing design, etc. In addition, due to the reduced available real estate and miniaturized component size, nonlinearities in the acoustic characteristics of such devices are becoming particularly relevant as the loudspeakers in such devices are being pushed to the limits of their capabilities.

Improved acoustic performance may be achieved, generally with additional cost, increased computational complexity, and/or increased component size. Such aspects are in conflict with the current design trend. As such, cost, computation, and size sensitive approaches to addressing nonlinear acoustic signatures of devices would be a welcome addition to a designer's toolbox.

SUMMARY

One objective of this disclosure is to provide a nonlinear control system for a loudspeaker.

Another objective is to provide a filter system for enhancing audio output from a consumer electronics device.

Yet another objective is to provide a manufacturing method for configuring a nonlinear control system in accordance with the present disclosure for an associated consumer electronics device.

The above objectives are wholly or partially met by devices, systems, and methods according to the appended claims in accordance with the present disclosure. Features and aspects are set forth in the appended claims, in the following description, and in the annexed drawings in accordance with the present disclosure.

According to a first aspect there is provided, a nonlinear control system for producing a rendered audio stream from one or more input signals including a controller configured to accept the input signal, and one or more estimated states, and to generate one or more control signals therefrom, a model configured to accept one or more of the control signals and generate one or more estimated states therefrom, and an audio system comprising at least one transducer, the audio system configured to accept one more of the control signals and to drive the transducer with the control signals or a signal generated therefrom to produce the rendered audio stream.

The model may include a feed forward nonlinear state estimator, configured to generate one or more of the estimated states.

The model may include an observer and the audio system may include a means for producing one or more feedback signals. The observer may be configured to accept one or more of the feedback signals or signals generated therefrom and to generate one or more of the estimated states from one or more of the feedback signals and one or more of the control signals.

In aspects, the observer may include a nonlinear observer, a sliding mode observer, a Kalman filter, an adaptive filter, a least means square adaptive filter, an augmented recursive least square filter, an extended Kalman filter, ensemble Kalman filter, high order extended Kalman filters, a dynamic Bayesian network. In aspects, the observer may include an unscented Kalman filter or an augmented unscented Kalman filter to generate one or more of the estimated states.

The controller may include a protection block, the protection block configured to analyze one or more of the input signals, the estimated states and/or the control signals and to modify the control signals based upon the analysis.

The controller may include a feed forward control system interconnected with a feedback control system, and the model may be configured to generate one or more reference signals from one or more of the estimated states, the feed forward control system may be configured to perform a nonlinear transformation on the input signals to produce an intermediate control signal and the feedback controller may be configured to compare two or more of the intermediate control signal, the reference signals, and the feedback signals to generate the control signals. The feedback controller may include a PID control block for generating one or more of the control signals. The feed forward controller may include an exact input-output linearization controller to generate one or more of the intermediate control signals.

In aspects, the audio system may include a driver configured to interconnect the control signal with the transducer. The driver may be configured to monitor one or more of a current signal, a voltage signal, a power signal, and/or a transducer impedance signal and to provide the signal as feedback to one or more component of the nonlinear control system.

The audio system may include a feedback coordination block configured to accept one or more sensory signals generated by one or more sensors, transducers, in the system and to generate one or more feedback signals therefrom.

The controller may include a target dynamics block and an inverse dynamics block. The target dynamics block may be configured to modify the input signal or a signal generated therefrom to generate a targeted spectral response therefrom. The inverse dynamics block may be configured to compensate for one or more nonlinear property of the audio system on the input signal or a signal generated therefrom.

The nonlinear control system may include an adaptive algorithm configured to monitor a distortion aspect of one or more signals within the nonlinear control system and to modify one or more aspects of the controller to reduce said distortion.

The controller may include one or more parametrically defined parameters, the function of the controller dependent on the parameters and the adaptive algorithm may be configured to adjust one or more of the parameters to reduce the distortion aspect.

The nonlinear control system may include means for estimating a characteristic temperature of the transducer and delivering the estimate to one or more of the controller and/or the model. The controller and/or the model may be configured to compensate for changes in the system performance associated with the characteristic temperature estimate.

The nonlinear control system may be integrated into a consumer electronics device. A consumer electronics device may include a cellular phone (e.g. a smartphone), a tablet computer, a laptop computer, a portable media player, a television, a portable gaming device, a gaming console, a gaming controller, a remote control, an appliance (e.g. a toaster, a refrigerator, a bread maker, a microwave, a vacuum cleaner, etc.) a power tool (a drill, a blender, etc.), a robot (e.g. an autonomous cleaning robot, a care giving robot, etc.), a toy (e.g. a doll, a figurine, a construction set, a tractor, etc.), a greeting card, a home entertainment system, an active loudspeaker, a media accessory (e.g. a phone or tablet audio and/or video accessory), a sound bar, and the like.

The transducer may an electromagnetic loudspeaker, a piezoelectric actuator, an electroactive polymer based loudspeaker, an electrostatic loudspeaker, combinations thereof, or the like.

According to another aspect, there is provided use of a nonlinear control system in accordance with the present disclosure included within in a consumer electronics device.

According to yet another aspect, there is provide use of a nonlinear control system in accordance with the present disclosure to process an audio signal.

According to another aspect there is provided a method for matching the performance of a production speaker to a target speaker model including configuring the production speaker with a nonlinear control system in accordance with the present disclosure, analyzing the performance of the production speaker, comparing the performance of the production speaker to that of the target speaker model, and adjusting the nonlinear control system to modify the performance of the production speaker to substantially match that of the target speaker model.

The method may include iteratively performing the steps of analyzing, comparing, and adjusting.

The step of adjusting may be at least partially performed with an optimization algorithm in accordance with the present disclosure. In aspects, the step of adjusting may be at least partially performed with an unscented Kalman filter.

BRIEF DESCRIPTION OF THE DRAWINGS

FIG. 3*a-e* show aspects of components of a nonlinear control system in accordance with the present disclosure.

DETAILED DESCRIPTION

Figure 1:
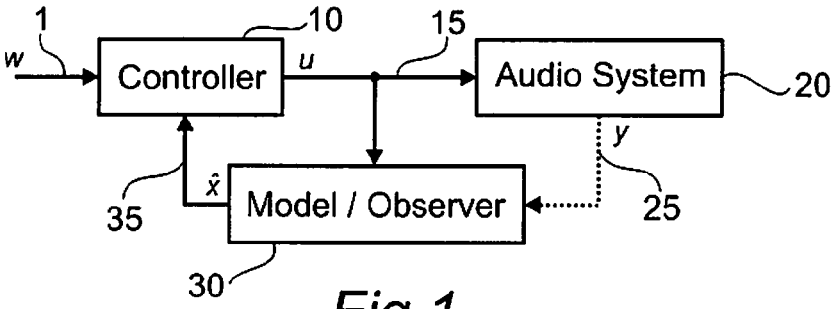
FIG. 1 shows a schematic of a nonlinear control system in accordance with the present disclosure.

Particular embodiments of the present disclosure are described herein below with reference to the accompanying drawings; however, the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. Like reference numerals may refer to similar or identical elements throughout the description of the figures.

By consumer electronic device is meant a cellular phone (e.g. a smartphone), a tablet computer, a laptop computer, a portable media player, a television, a portable gaming device, a gaming console, a gaming controller, a remote control, an appliance (e.g. a toaster, a refrigerator, a bread maker, a microwave, a vacuum cleaner, etc.) a power tool (a drill, a blender, etc.), a robot (e.g. an autonomous cleaning robot, a care giving robot, etc.), a toy (e.g. a doll, a figurine, a construction set, a tractor, etc.), a greeting card, a home entertainment system, an active loudspeaker, a media accessory (e.g. a phone or tablet audio and/or video accessory), a sound bar, etc.

By input audio signal is meant one or more signals (e.g. a digital signal, one or more analog signals, a 5.1 surround sound signal, an audio playback stream, etc.) provided by an external audio source (e.g. a processor, an audio streaming device, an audio feedback device, a wireless transceiver, an ADC, an audio decoder circuit, a DSP, etc.).

By acoustic signature is meant the audible or measurable sound characteristics of a consumer electronic device and/or a component thereof (e.g. a loudspeaker assembly, with enclosure, waveguide, etc.) dictated by its design that influence the sound generated by the consumer electronic device and/or a component thereof. The acoustic signature may be influenced by many factors including the loudspeaker design (speaker size, internal speaker elements, material selection, placement, mounting, covers, etc.), device form factor, internal component placement, screen real-estate and material makeup, case material selection, hardware layout, and assembly considerations amongst others. Cost reduction, form factor constraints, visual appeal and many other competing factors are favored during the design process at the expense of the audio quality of the consumer electronic device. Thus the acoustic signature of the device may deviate significantly from an ideal response. In addition, manufacturing variations in the above factors may significantly influence the acoustic signature of each device, causing further part to part variations that degrade the audio experience for a user. Some non-limiting examples of factors that may affect the acoustic signature of a consumer electronic device include: insufficient speaker size, which may limit movement of air necessary to re-create low frequencies, insufficient space for the acoustic enclosure behind the membrane which may lead to a higher natural roll-off frequency in the low end of the audio spectrum, insufficient amplifier power available, an indirect audio path between membrane and listener due to speaker placement often being on the back of a TV or under a laptop, relying on reflection to reach the listener, among others factors.

An acoustic signature may include one or more nonlinear aspects relating to material selection, design aspects, assembly aspects, etc. that may influence the audio output from the associated device, causing such effects as intermodulation, harmonic generation, sub-harmonic generation, compression, signal distortion, bifurcation (i.e. unstable states), chaotic behavior, air convective aspects, and the like. Some non-limiting examples of nonlinear aspects include eddy currents, cone positional nonlinearities, coil/field nonlinearities, DC coil displacement, electromechanical nonlinearities (e.g. magnetic and/or E-field hysteresis), viscoelastic and associated mechanical aspects (e.g. suspension nonlinearities, nonlinear damping, in the spider, mounting frame, cone, suspension geometry, etc.), assembly eccentricities, driver characteristics, thermal characteristics, acoustic radiation properties (e.g. radiation, diffraction, propagation, room effects, convection aspects, etc.), audio perception characteristics (e.g. psychoacoustic aspects), and the like.

Such nonlinear aspects may be amplitude dependent (e.g. thermally dependent, cone excursion dependent, input power dependent, etc.), age dependent (e.g. changing over time based on storage and/or operating conditions), operating environment dependent (e.g. based on slow onset thermal influences), aging of mechanical and/or magnetic dependent (e.g. depolarization of associated magnetic materials, aging of rubber and/or polymeric mounts, changes associated with dust collection, etc.), dependent upon part-to-part variance (e.g. associated with manufacturing in precision, positioning variance during assembly, varied mounting pressure, etc.), and the like.

A nonlinear control system in accordance with the present disclosure may be configured to compensate for one or more of the above aspects, preferably during playback of a general audio stream. Such nonlinear control systems may be advantageous to effectively extend the audio quality associated with an audio stream to the limits of what the associated hardware can handle.

FIG. 1 shows a schematic of a nonlinear control system in accordance with the present disclosure. The nonlinear control system includes a controller 10 configured to accept an input signal 1 from an audio source (not explicitly shown) and one or more states 35. The system may include a model and/or observer 30 (referred to hear-in as model 30 for the sake of discussion), configured to generate the states 35. The controller 10 may generate one or more control signals 15 to drive an associated audio system 20. The control signals 15 may be fed to the model 30 for inclusion into the estimation of the states 35. The audio system 20 may produce one or more feedback signals 25, which may be directed to the model 30 for use in generating the states 35.

The controller 10 may include a control strategy based upon one or more of adaptive control, hierarchical control, neural networks, Bayesian probability, backstepping, Lyapunov redesign, H-infinity, deadbeat control, fractional-order control, model predictive control, nonlinear damping, state space control, fuzzy logic, machine learning, evolutionary computation, genetic algorithms, optimal control, model predictive control, linear quadratic control, robust control processes, stochastic control, combinations thereof, and the like. The controller 10 may include a full non-linear control strategy (e.g. a sliding mode, bang-bang, BIBO strategy, etc.), as a linear control strategy, or a combination thereof. In one non-limiting example, the controller 10 may be configured in a fully feed-forward approach (i.e. as an exact input-output linearization controller). Alternatively, additionally or in combination, one or more aspects of the controller 10 may include a feed-back controller (e.g. a nonlinear feedback controller, a linear feedback controller, a PID controller, etc.), a feed-forward controller, combinations thereof, or the like.

A controller 10 in accordance with the present disclosure may include a band selection filter (e.g. a bandpass, low pass filter, etc.) configured so as to modify the input signal 1 to produce a modified input signal (i.e. an input signal with limited spectral content, spectral content relevant to the nonlinear control system only, etc.). In one non-limiting example, the controller 10 may include a filter with a crossover positioned at approximately 60 Hz. The nonlinear control may be applied to the spectral content below the cross over while the rest of the signal may be sent elsewhere in the system, enter an equalizer, etc. The signals may be recombined before being directed towards the audio system 20. In a multi-rate example, the signals maybe downsampled and upsampled accordingly, based on their spectral content and the harmonic content added by the nonlinear controller 10 during operation. Such a configuration may be advantageous for reducing the computational load on the control system during real-time operation.

The model 30 may include an observer and/or a state estimator. A state estimator (e.g. an exact linearization model, a feed forward model, etc.) may be configured to estimate the states 35 for input to the controller 10. The state estimator may include a state space model in combination with an exact input-output linearization algorithm in order to achieve this function, among other approaches. One or more aspects of the model 30 may be based upon a physical model (e.g. a lumped parameter model, etc.). Alternatively, additionally, or in combination, one or more aspects of the model 30 may be based upon a general architecture (e.g. a black box model, a neural network, a fuzzy model, a Bayesian network, etc.). The model 30 may include one or more parametrically defined aspects that may be configured, calibrated, and/or adapted to better accommodate the specific requirements of the given application.

The feedback signals 25 may be obtained from one or more aspects of the audio system 20. Some non-limiting examples of feedback signals 25 include one or more temperature measurements, impedance, drive current, drive voltage, drive power, one or more kinematic measurements (e.g. membrane or coil displacement, velocity, acceleration, air flow, etc.), sound pressure level measurement, local microphone feedback, ambient condition feedback (i.e. temperature, pressure, humidity, etc.), kinetic measurements (e.g. force at a mount, impact measurement, etc.), B-field measurement, combinations thereof, and the like.

The states 35 may be generally determined as input to the controller 10. In aspects, the states 35 may be transformed so as to reduce computational requirements and/or simplify calculation of one or more aspects of the system.

The control signals 15 may be delivered to one or more aspects of the audio system 20 (e.g. to a driver included therein, to a loudspeaker included therein, etc.).

The model 30 may include an observer (e.g. a nonlinear observer, a sliding mode observer, a Kalman filter, an adaptive filter, a least means square adaptive filter, an augmented recursive least square filter, an extended Kalman filter, ensemble Kalman filter, high order extended Kalman filters, a dynamic Bayesian network, etc.). In aspects, the model 30 may be an unscented Kalman filter (UKF). The unscented Kalman filter may be configured to accept the feedback signal 25, the input signal 1, and/or the control signal 15. The unscented Kalman filter (UKF) 30 may include a deterministic sampling technique known as the unscented transform to pick a minimal set of sample points (i.e. sigma points) around the mean nonlinear function. The sigma points may be propagated through the non-linear functions, from which the mean and covariance of the estimates are recovered. The resulting filter may more accurately capture the true mean and covariance of the overall system being modeled. In addition, UKF do not require explicit calculation of Jacobians, which for complex functions may be challenging, especially on a resource limited device.

The UKF algorithm may include weight matrices that depend on the design variables α, β and κ. The variable a may be configured between 0 and 1, β may be set equal to 2 (i.e. if the noise profile is roughly Gaussian), and κ is a scaling factor that may generally be set equal to zero or generally 3-n, where n is the number of states. Generally speaking, κ should be nonnegative to ensure the covariance matrix to be positive semi-definite. For purposes of discussion, λ is introduced and defined as:

$$\lambda=\alpha^2(n+\kappa)-n \qquad \text{Equation 1}$$

and the calculations of the weights are:

$$W_m^0=\lambda/(n+\lambda)$$

$$W_c^0=\lambda/(n+\lambda)+1-\alpha^2+\beta$$

$$W_m^i=1/(2(n+\lambda)),i=1,2,\ldots,2n$$

$$W_c^i=1/(2(n+\lambda)),i=1,2,\ldots,2n \qquad \text{Equation 2}$$

which are assembled into:

$$W_m=[W_m^0 W_m^2 \ldots W_m^{2n}]^T$$

$$W_c=[W_c^0 W_c^1 \ldots W_c^{2n}]^T \qquad \text{Equation 3}$$

The prediction step may be defined by a sigma-point vector:

$$X_{k-1}=[m_{k-1} \ldots m_{k-1}]+\sqrt{n+(}[0\sqrt{P_{k-1}}-\sqrt{P_{k-1}}] \qquad \text{Equation 4}$$

based on the prior mean, $m_{k-1}$, and covariance, $P_{k-1}$. The vector can be divided into single sigma points $W_{k-1}^j$ for j=1, 2, . . . , 2n+1. The points are then propagated through the non-linear function:

$$\hat{X}_k^j=f(\hat{X}_{k-1}^j,u_{k-1}) \qquad \text{Equation 5}$$

By assembling all $\hat{X}_k^j$ as $$\hat{X}_k=[\hat{X}_k^1 \ldots \hat{X}_k^{2n+1}] \qquad \text{Equation 6}$$

with the resulting mean and covariance predicted by:

$$\overline{m}_k=\hat{X}_k W_m$$

$$\overline{P}_k=\hat{X}_k W_c \hat{X}_k^T+Q \qquad \text{Equation 7}$$

where the covariance of the process noise is denoted Q. The updated sigma points are given by:

$$\overline{X}_k=[\overline{m}_k \ldots \overline{m}_k]+\sqrt{n+(}[0\sqrt{P_k}-\sqrt{P_k}] \qquad \text{Equation 8}$$

The resulting sigma points are then propagated through the measurement function:

$$\overline{Z}_k^j=h(\overline{X}_k^j) \qquad \text{Equation 9}$$

and a corresponding Kalman filter gain is calculated:

$$S_k=\overline{Z}_k W_c \overline{Z}_k^T+R$$

$$C_k=\overline{X}_k W_c \overline{Z}_k^T$$

$$K_k=C_k S_k^{-1} \qquad \text{Equation 10}$$

The matrix R is the covariance matrix for the measurement noise. Finally, the estimated mean and covariance are updated according to:

$$P_k=\overline{P}_k-K_k S_k K_k^T$$

$$m_k=\overline{m}_k+K_k(z_k-\overline{u}_k)$$

$$\overline{u}_k=\overline{Z}_k W_m \qquad \text{Equation 11}$$

In one non-limiting example, the unscented Kalman filter may be augmented (i.e. to form an augmented unscented Kalman filter [AUKF]). The AUKF includes an augmented state vector for the process and measurement noise calculation thus including non-symmetric sigma points. The AUKF may be advantageous for capturing odd-moment information during each filtering recursion.

Figure 2:
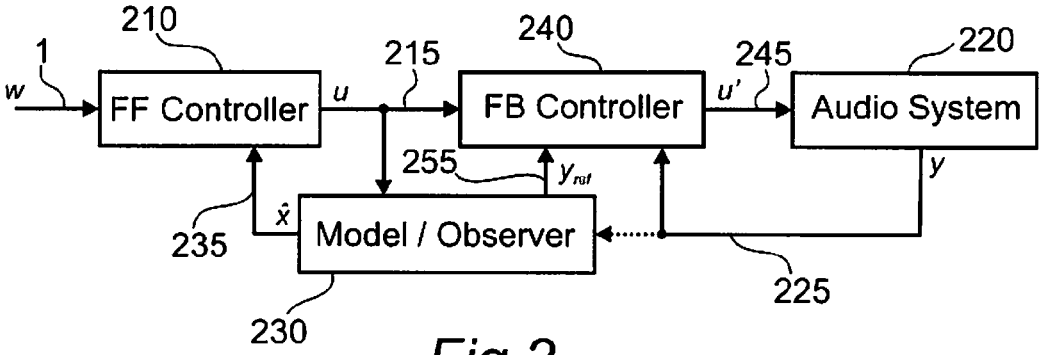
FIG. 2 shows a schematic of a nonlinear control system in accordance with the present disclosure.

FIG. 2 shows a schematic of a nonlinear control system in accordance with the present disclosure. The control system includes a feed-forward controller 210 configured to accept an audio input 1 and one or more states 235, and to produce one or more control signals 215. The control system also includes a feed-back controller 240 configured to accept one or more of the control signals 215, one or more feedback signals 225, and one or more reference signals 255 to produce an updated control signal 245. The control system may also include a model 230 in accordance with the present disclosure configured to accept one or more control inputs 215 and optionally one or more feedback signals 225, and to produce the states 235 and one or more reference signals 255. The model 230 may include a state estimator and/or an observer, configured to generate the states 235 and/or the reference signals 255. The reference signals 255 may be generated so as to provide a prediction of one or more of the intended feedback signals 225 for use in the Feedback controller 240. The updated control signal 245 may be used to drive one or more components of an associated audio system 220 in accordance with the present disclosure. The audio system 220 may be configured to provide one or more feedback signals 225 for use by one or more aspects of the control system.

In aspects, the feed-forward controller 210 may be configured as a nonlinear exact input-output linearization controller while the feed-back controller 240 may be a state space controller (e.g. a P, PI, PD, PID controller, etc.). The feed-forward controller 210 may effectively linearize the system nonlinearities, thus providing a linear control signal 215 for input to the Feedback controller 240. In aspects, a parametric system model may be derived, pertaining to the specific implementation of the nonlinear control system. The feed-forward controller may be directly derived from the parametric model so as to cancel the nonlinear aspects thereof in the overall signal pathway.

For purposes of discussion, a non-limiting example of a suitable feed forward control law is given in Equation 12:

$$u = \left\{ Mv + \frac{x_2}{C_{ms}(x_1)}\left(1 - \frac{x_1}{C_{ms}(x_1)} \cdot \frac{dC_{ms}(x_1)}{dx_1}\right) + \frac{R_{ms}}{M}\left(\frac{-x_1}{C_{ms}(x_1)} - R_{ms}X_2 + \left(B1(x_1) + \frac{1}{2} \cdot \frac{dL_e(x_1)}{dx_1}x_3\right)x_3 + \frac{1}{2} \cdot \frac{dL_2(x_1)}{dx_1}x_4^2\right) - x_2x_3\frac{dB1(x_1)}{dx_1} - \frac{1}{2}x_2x_3^2\frac{d^2L_e(x_1)}{dx_1^2} - \frac{1}{2}x_2x_4^2\frac{d^2L_2(x_1)}{dx_1^2} - \frac{x_4}{L_2(x_1)} \cdot \frac{dL_2(x_1)}{dx_1}\left(R_2(x_1)x_3 - \left(R_2(x_1) - x_2\frac{dL_2(x_1)}{dx_1}\right)x_4\right)\right\} \cdot \left(\frac{L_e(x_1)}{B1(x_1) + x_3\frac{dL_e(x_1)}{dx_1}}\right) + B1(x_1)x_2 + x_2x_3\frac{dL_e(x_1)}{dx_1} + R_ex_3 + R_2x_3 - R_2x_4 \qquad \text{Equation 12}$$

Figure 5A:
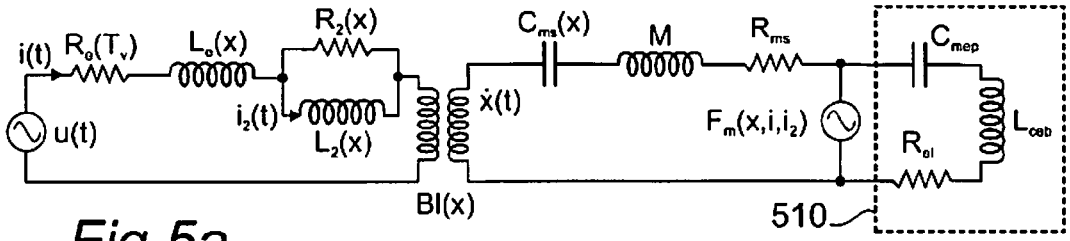
FIGS. 5*a-b* show non-limiting examples of nonlinear models representing one or more aspects of an audio system in accordance with the present disclosure.

Equation 12 demonstrates a parametrically defined control law based upon the loudspeaker model shown in FIG. 5*a* The states 235 are represented in the equation as $x_1, \ldots, x_4$. The control law is of lower order than the states, thus a transformation may be used to accommodate any zero dynamics associated with this condition.

The states may be provided by a state estimator, included in the model 230. The state estimator algorithm would be a counterpart to equation 12.

The states may also be provided by an observer in accordance with the present disclosure. Continuing with the specific example herein, a Kalman filter based observer may be derived by applying equations 1-11 to this specific example. In the case of an augmented unscented Kalman filter, an augmented state vector may be included, such as shown below in equation 13:

$$x_a = [x^T W^T V^T]^T \qquad \text{Equation 13}$$

where x is the state vector, W is a vector containing the noise variables, and V is a vector containing the measurement noise variables.

The unscented Kalman filter (UKF) is founded on the intuition that it is easier to approximate a probability distribution than it is to approximate an arbitrary nonlinear function or transformation. The unscented Kalman filter (UKF) is a way of estimating the state variables of a nonlinear system by calculating the mean. It belongs to a bigger class of filters called Sigma-Point Kalman filters which make use of statistical linearization techniques. It uses the unscented transform which is a method for statistically calculating a stochastic variable which goes through a nonlinear transformation. The non-augmented UKF, which assumes additive noise, uses the unscented transformation to make a Gaussian approximation to the nonlinear problem given as $$x_k = f(x_{k-1}, k-1) + q_{k-1}$$

$$y_k = h(x_k, k) + r_k \qquad \text{Equation 14}$$

where $x_k$ is the state vector, $y_k$ is the measurement vector, $q_{k-1}$ is the process noise and $r_k$ is measurement noise defined as $$x_k \in \mathbb{R}^n$$

$$y_k \in \mathbb{R}^m$$

$$q_{k-1} \sim N(0, Q_{k-1})$$

$$r_k \sim N(0, R_k) \qquad \text{Equation 15}$$

Similar to the Kalman filter, the UKF consists of two steps, prediction and update. Unlike the Kalman filter though, the UKF makes use of so called sigma points, which are used to better capture the distribution of x. The mean values of that distribution will here be indicated as m. The sigma points X are then propagated through the nonlinear function f and the moments of the transformed variable estimated.

For the non-augmented UKF a set of 2n+1 of sigma points is used, where n is the order of the states. Before going through the prediction and update steps the associated weight matrices $W_m$ and $W_c$ need to be defined. This is done as follows:

$$W_m^{(0)} = \lambda/(n+\lambda)$$

$$W_c^{(0)} = \lambda/(n+\lambda) + (1-\alpha^2+\beta)$$

$$W_m^{(i)} = 1/\{2(n+\lambda)\}, i=1, \ldots, 2n$$

$$W_c^{(i)} = 1/\{2(n+\lambda)\}, i=1, \ldots, 2n$$

$$W_m^{(0)} \ldots W_m^{(i)} \text{ and } W_c^{(0)} \ldots W_c^{(i)} \qquad \text{Equation 16}$$

where W are column vectors for the weight matrices.

The scaling parameter λ is defined as:

$$\lambda = \alpha^2(n+\kappa) - n \qquad \text{Equation 17}$$

where α, β and κ are positive constants which can be used to tune the UKF by modifying the associated weighting matrices. The prediction and update steps can now be computed as follows:

Prediction: The prediction step computes the predicted state mean $m_k^-$ and the predicted co-variance $P_k^-$ by calculating the sigma points $X_{k-1}$.

$$X_{k-1} = [m_{k-1} \ldots m_{k-1}] + \sqrt{c}[0 \sqrt{P_{k-1}} - \sqrt{P_{k-1}}]$$

$$\hat{X}_k = f(X_{k-1}, k-1)$$

$$m_k^- = X_k W_m$$

$$P_k^- = \hat{X}_k W_c [\hat{X}_k]^T + Q_{k-1} \qquad \text{Equation 18}$$

Update: The update step computes the predicted mean $\mu_k$, measurement covariance $S_k$ and the measurement and state cross-covariance $C_k$:

$$X_k^- = [m_k^- \ldots m_k^-] + \sqrt{c}[0\sqrt{P_k^-} - \sqrt{P_k^-}]$$

$$Y_k^- = h(X_k^-, k)$$

$$\mu_k^- = Y_k^- W_m$$

$$S_k = Y_k^- W_c [Y_k^-]^T + R_k$$

$$C_k = X_k^- W_c [Y_k^-]^T \qquad \text{Equation 19}$$

The filter gain $K_k$, the updated state mean $m_k$ and the covariance $P_k$ are computed according to:

$$K_k = C_k S_k^{-1}$$

$$m_k = m_k^- + K_k[y_k - \mu_k]$$

$$P_k = P_k^- - K_k S_k K_k^T \qquad \text{Equation 20}$$

Initial values for the mean m and the covariance P need to be chosen for the first run. Afterwards, the algorithm can simply be run iteratively.

In aspects, the feed-back controller 240 may be configured in accordance with the present disclosure. In aspects, the feed-back controller 240 may be configured to modify the control signal 215 in order to minimize the error between the reference signal 255 and the feedback signal 225. One such non-limiting example of a suitable feed-back controller 240 may be a PID controller. The PID controller may be configured and/or optimized by a known scheme (e.g. brute-force iteration while measuring speaker THD, or the like).

In aspects, the feedback signal may be a current signal and the reference signal may be a current signal as approximated by the feed forward controller, state estimator, or an equivalent observer.

FIG. 3*a-e* show aspects of components of a nonlinear control system in accordance with the present disclosure.

Figure 3A:
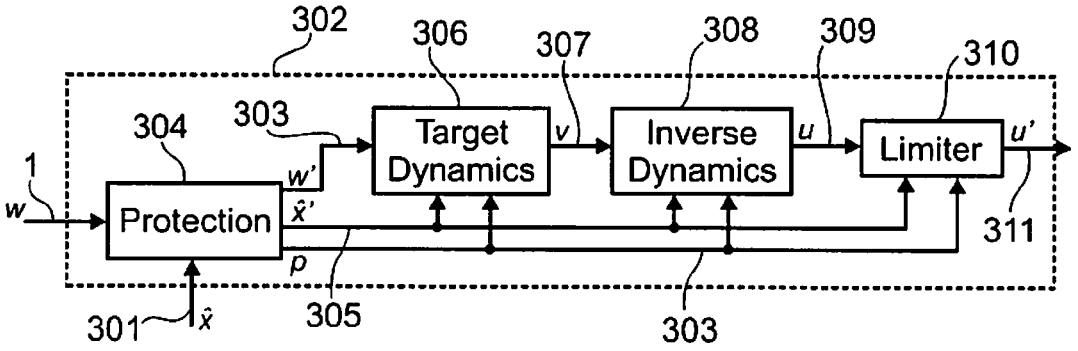

FIG. 3*a* shows aspects of a feed-forward controller 302 in accordance with the present disclosure. The feed-forward controller 302 may be configured to accept an input signal 1 and a state vector 301 and generate one or more control signals 311. In a basic configuration, the feed-forward controller 302 includes a target dynamics block 306 configured to accept the input signal 1 or a signal derived therefrom (e.g. a modified input signal 303), and a state vector 301 or signal derived therefrom (e.g. a modified state vector 305), and optionally a flag 303 (e.g. a signal generated by one or more components of the control system), and generate a targeted output signal 307. The target dynamics block 306 may be configured so as to provide a desired transformation for the input signal 1 (e.g. an equalizer function, a compressor function, a linear inverse dynamic function, additional added harmonics, etc.).

The controller 302 may include an inverse dynamics block 308 configured to compensate for one or more nonlinear aspects of the audio system (e.g. one or more nonlinearities associated with the loudspeaker, the driver, the enclosure, etc.). The inverse dynamics block 308 may be configured to accept the targeted output signal 307, a state vector 301 or signal derived therefrom (e.g. a modified state vector 305), and optionally a flag 303 (e.g. a signal generated by one or more components of the control system), and generate one or more initial control signals 309. The inverse dynamics block 308 may be configured based on a black or grey box model, or equivalently from a parametric model (such as the lumped parameter model outlined herein). Thus, the system may include a pure "black-box" modeling approach (i.e. a model with no physical basis, but rather a pure input-to-output behavior mapping that can then be compensated for). In some instances, a physically targeted model may reduce the computational load on the nonlinear control system.

The controller 302 (e.g. a non-limiting implementation of a controller 10, a feed-forward controller 210, etc.) may include a protection block 304, configured to accept one or more input signals 1 and one or more states 301 and optionally produce one or more modified input signals 303, modified states 305, and/or a flag 303. The protection block 304 may be configured to compare one or more aspects of the input signal 1, the state vector 301 or one or more signals generated therefrom (e.g. an input power signal, a state power signal, a thermal state, cone excursion, a thermal dynamic, a thermal approach vector, etc.). The protection block 304 may compare such information against a performance limitation criteria (e.g. a thermal model, an excursion limitation, a power consumption limitation of the associated device [i.e. a configurable criteria], etc.) to determine how close the operating condition of the audio system is to a limit, the rate at which the operating state is approaching a limit (e.g. a thermal limit), etc.

Such functionality may be advantageous for generating a look a-head trajectory for smoothly transitioning system gain, performance aspects, etc. so as to remain within the limitation criteria as well as reduce the probability of introducing audio artifacts based when applying limits to the system.

In aspects, the protection block 304 may generate such information in terms of a flag 303 (e.g. a warning flag, a problem flag, etc.), the flag 303 configured so as to indicate a level of severity to one or more aspects of the control system, to assist with parametrically limiting the output of one or more aspect of the control system, etc. Alternatively, additionally, or in combination, the protection block 304 may directly augment the input signal 1, the states 301, so as to generate a modified input signal 303 or a modified state vector 305, so as to provide the protection aspect without addition computational complexity to other aspects of the control system.

The controller 302 may include a compressor and/or a limiter 310 configured to accept the initial control signal 309, one or more states 301 or signals generated therefrom (e.g. a modified state vector 305), or the flag 303. The limiter 310 may be configured to limit the initial control signal 309 based on one or more aspects of the states 303, the initial control signal 309, the flag 303, combinations thereof, and the like. The limiter 310 may be configured to generate a limited control signal 311 for use by one or more components in the control system. In aspects, the limiter 310 may be implemented as a compressor, with a limit configured based upon a predetermined criteria and/or the flag 303.

FIG. 3*b* shows aspects of an audio system 20 (i.e. 220, etc.) in accordance with the present disclosure. The audio system 20 may include one or more transducers (e.g. loudspeakers, actuator, etc.). By transducer 318 is meant a component or device such as a loudspeaker suitable for producing sound (e.g. an audio signal 321). A transducer 318 may be based on one of many different technologies such as electromagnetic, thermoacoustic, electrostatic, magnetostrictive, ribbon, audio arrays, electroactive materials, and the like. Transducers 318 based on different technologies may require alternative driver characteristics, matching or filtering circuits but such aspects are not meant to alter the scope of this disclosure.

The audio system 20 may include a transducer module 332, which may further include a transducer 318 and a circuit 316. The circuit 316 may provide additional functionality (e.g. power amplification, energy conversion, filtering, energy storage, etc.) to enable a driver 314 external to the transducer module 332 to drive the transducer 318. Some non-limiting examples of the circuit 316 (e.g. a passive filter circuit, an amplifier, a de-multiplexer, a switch array, a serial communication circuit, a parallel communication circuit, a FIFO communication circuit, a charge accumulator circuit, etc.) are highlighted throughout the disclosure.

The circuit 316 may be configured with one or more sensory functions, configured so as to produce a loudspeaker feedback 319. The loudspeaker feedback 319 may include a current signal, a voltage signal, an excursion signal, a kinetic signal, a cone reflection signal (i.e. an optical signal directed at the cone of the loudspeaker), a pressure sensor, a magnetic signal sensor (e.g. a field strength measurement, a field vector, etc.), combinations thereof, and the like. The loudspeaker feedback signal 319 may be configured for use by one or more component in the control system.

The driver(s) 314 may be half bridge, full bridge configurations, and may accept one or more PWM signals to drive either the corresponding high and low side drivers. The driver(s) 314 may include a class D amplifier, a balanced class D amplifier, a class K amplifier, or the like. The driver(s) 314 may include a feedback circuit for determining a current flow, voltage, etc. delivered to the transducer(s) during use. The amplifier may include a feedback loop, optionally configured to reduce one or more nonlinearities in one or more transducers 318 and/or the electrical components in the system.

The driver 314 may include one or more sensory circuits to generate a driver feedback signal 317. The driver feedback signal 317 may include a power signal, a current signal, an impedance measurement (i.e. a spectral measurement, a low frequency measurement, etc.), a voltage signal, a charge, a field strength measurement, or the like.

In aspects, the driver 314 is configured to monitor one or more aspects of the impedance of an associated loudspeaker 318. The impedance may be measured so as to establish a substantially DC impedance (i.e. the loudspeaker impedance as measured in subsonic spectrum) measurement of the loudspeaker, which may be at least partially indicative of a characteristic temperature of the loudspeaker coil. The impedance may be measured in combination with a current sensing resistor, in combination with a measurement of the voltage applied to the loudspeaker.

In aspects, pertaining to a driver 314 implementation with a class-D amplifier, the loudspeaker impedance may be calculated from the output current of the class-D amplifier. The current may be pulsed along with the ON-OFF cycles associated with the amplifier. Thus, a relevant current signal may be obtained by low pass filtering the output current. The filter may be configured so as to obtain one or more spectral components of the current signal. In one non-limiting example, the impedance spectrum may be assessed in order to determine the frequency of the first resonant mode of the loudspeaker, and/or the impedance at the peak of the first resonant frequency. As the impedance or associated frequency of the first resonant peak may change in association with the excursion of the coil and/or the temperature of the coil. A comparison of the impedance measured at the resonant peak with that of in the sub-sonic spectrum may be employed to extract substantially independent measurements of the excursion and the coil temperature during use.

The impedance of the loudspeaker may be measured at the driver 314, for use in matching one or more control parameters, or model parameters to the physical system of the immediate example (e.g. the impedance may be used during optimization of one or more aspects of the model 30).

In aspects, at least a portion of the observer may be configured so as to capture and/or track the first resonant peak of the loudspeaker. The observer may include one or more algorithms (e.g. a frequency tracking algorithm based on an unscented Kalman filter, AUKF, etc.) configured to extract the first resonant peak from one or more aspects of the control signal 15 and/or the feedback signal 25. Additionally, alternatively, or in combination, the algorithm may be configured to calculate a loudspeaker impedance parameter at the fundamental resonant peak. Such an algorithm may be advantageous for performing such frequency extraction and/or impedance measurement in real-time amongst a general audio stream (e.g. during streaming of music, voice, etc.). With such information available, one or more controllers in the nonlinear control system may be configured to compensate for the resonant peak during operation. Such action may be advantageous to dramatically increase drive capability of the associated loudspeaker without the need to impart mechanically damped solutions to the problem (i.e. by directly compensating, a high efficiency solution may be attained).

The audio system 20 may include one or more microphones 324, 326 configured to monitor one or more aspects of the audio signal 321 during use. One or more of the microphones may be hardwired to the system 323 (e.g. a microphone located on the associated consumer electronics device). Such a microphone 324 may be advantageous for capturing one or more aspects of the sound propagation in the vicinity of the loudspeaker, associated with the loudspeaker enclosure, the device body, etc.

In aspects, the audio system 20 may include a wirelessly connected microphone 326 (e.g. connected via a wireless link 325, 328, 330, 327), perhaps connected to an associated consumer electronics device, in the vicinity of the control system, on a manufacturing configuration (as part of a manufacturing based calibration system, etc.). The wirelessly connected microphone 326 may be advantageous for capturing one or more aspects of sound propagation in the environment around the loudspeaker, with directional aspects of sound propagation from the loudspeaker, etc.

In aspects, the audio system 20 may include a loudspeaker 318. In aspects, the audio system 20 may include a driver 314 and a loudspeaker 318.

The audio system 20 may include one or more device sensors 322 which may be configured to capture one or more ambient and/or kinematic aspects of the usage environment, orientation with respect to a user (i.e. handheld, held to the head, etc.). Some non-limiting examples of suitable device sensors 322 include ambient temperature sensors, pressure sensors, humidity sensors, magnetometers, proximity sensors, etc. In aspects, the ambient temperature may be measured by a temperature sensor (i.e. a device sensor 322). The ambient temperature may be employed by one or more components in the control system as part of a protection algorithm, as input to one or more aspects a thermal model, etc.

The audio system 20 may include a feedback coordinator 320 configured to accept signals from one or more components of the audio system 20 (i.e. driver 314, transducer module 332, circuit 316, transducer 318, microphones 324, 326, device sensors 322) and generate one or more feedback signals 25. The feedback coordinator 320 may include one or more signal conditioning algorithms, sensor fusion algorithms, algorithms for generating one or metrics from one or more sensor signals, extracting one or more spectral components from the signals, etc.

FIG. 3*c* shows a model 30*a* in accordance with the present disclosure. The model 30*a* includes a state estimator 336 in accordance with the present disclosure and optionally an output estimator 334. The state estimator 336 may be configured to accept one or more control signals 15 and generate one or more state vectors 35. The output estimator 334 may accept one or more states 35 and generate one or more reference signals 302. The reference signals 302 may be produced for purposes of comparison by one or more controllers in the control system, for feedback to a protection system, etc. The output estimator 334 may include a transfer function, a nonlinear transfer function, a state based estimator, etc.

FIG. 3*d* shows a model 30*b* in accordance with the present disclosure. The model 30*b* includes an observer 340 in accordance with the present disclosure and optionally an output estimator 338. The observer 340 may be configured to accept one or more control signals 215, and one or more feedback signals 225, and generate one or more state vectors 235. The output estimator 338 may accept one or more states 235 and generate one or more reference signals 255. The reference signals 255 may be produced for purposes of comparison by one or more controllers in the control system, for feedback to a protection system, etc. The output estimator 338 may include a transfer function, a nonlinear transfer function, a state based estimator, etc.

In aspects, the observer 340 may include an augmented unscented Kalman filter for extracting the states from the control signals 215 and the feedback signals 225.

FIG. 3*e* shows aspects of a feedback controller 305 in accordance with the present disclosure. The feedback controller 305 includes a control block 344 (e.g. a nonlinear control law, a PID controller, etc.) in accordance with the present disclosure, and optionally a signal conditioner 346. The feedback controller 305 may be configured to accept one or more feedback signals 225 and compare the feedback signals 225 or signals generated therefrom (e.g. a conditioned feedback signal 345) with one or more reference signals 255 (i.e. as generated by one or more components in the control system). The compared signal is provided to the control block 344 where suitable gain is added to the signal to force the feedback signal 225 towards the reference signal 255. The resulting control signal 327 may be added to the initial control signal 215 (i.e. as produced by one or more control components of the control system) to produce a modified control signal 245.

Figure 4:
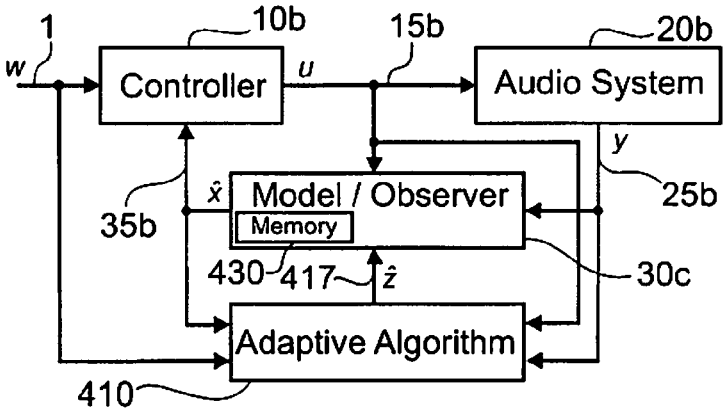
FIG. 4 shows a schematic of an adaptive nonlinear control system in accordance with the present disclosure.

FIG. 4 shows a schematic of an adaptive nonlinear control system in accordance with the present disclosure. The adaptive nonlinear control system includes a controller 10*b* according to the present disclosure configured to accept one or more signals 1 and one or more states 35*b* or signals generated therefrom. The adaptive nonlinear control system includes a model 30*c* in accordance with the present disclosure. The model 30*c* is configured to accept one or control signals 15*b*, one or more feedback signals 25*b*, and/or one or more adapted parameters 417. The model 30*c* may include a model and/or observer including one or more weighting parameters, parametric parameters, coefficients or the like. The parameters may be stored locally in a memory block 430 or otherwise integrated into the structure of the model 30*c*. The parameters may be at least partially dependent upon the adapted parameters 417. The adaptive nonlinear control system includes an adaptive block 410 configured to accept one or more feedback signals 25*b*, one or more control signals 15*b*, one or more input signals 1, one or more states 35*b*, each in accordance with the present disclosure, and generate one or more of the adapted parameters 417.

The adaptive block 410 may be configured to alter the adapted parameters 417 during predetermined tests, during casual operation of the nonlinear control system, at predetermined times during media streaming, as one or more components of the operating system change, as operating conditions change, as one or more key operational aspects (e.g. operating temperature) changes, etc. The adaptive block 410 may include one or more aspects configured to assess the "goodness of fit" of the current model 30*c*. Upon determination that the fit is insufficient, the adaptive block 410 may perform one or more operations to correct the model 30*c* accordingly.

The adaptive block 410 may include one or more adaptive and/or learning algorithms. In aspects, the adaptive algorithm may include an augmented unscented Kalman filter. In aspects, a least squares optimization algorithm may be implemented to iteratively update the adapted parameters 417 between tests, as operating conditions change, as one or more key operational aspects (e.g. operating temperature) changes, etc. Other, non-limiting examples of optimization techniques and/or learning algorithms include non-linear least squares, L2 norm, averaged one-dependence estimators (AODE), Kalman filters, unscented Kalman filters, Markov models, back propagation artificial neural networks, Bayesian networks, basis functions, support vector machines, k-nearest neighbors algorithms, case-based reasoning, decision trees, Gaussian process regression, information fuzzy networks, regression analysis, self-organizing maps, logistic regression, time series models such as auto regression models, moving average models, autoregressive integrated moving average models, classification and regression trees, multivariate adaptive regression splines, and the like.

Figure 5B:
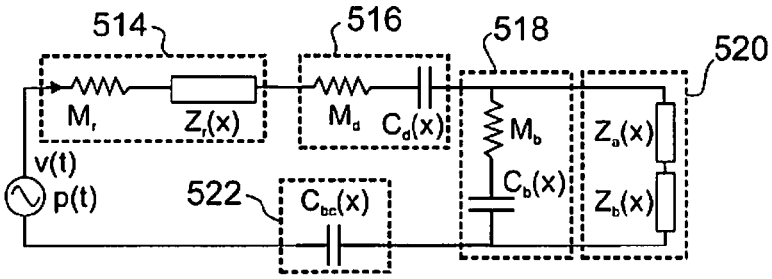

FIGS. 5*a-b* show aspects of nonlinear models to represent one or more aspects of an audio system in accordance with the present disclosure. For purposes of discussion, lumped parameter models are discussed herein, in order to highlight one or more aspects or relationships there between. For purposes of discussion, the non-limiting example shown in FIG. 5*a* represents a transducer based upon a moving coil loudspeaker and an associated enclosure and driver. Various aspects of the model are discussed herein.

The loudspeaker model shown in FIG. 5*a* includes spatially dependent parametrically defined lumped parameter aspects of physically identifiable components within the system. Relevant nonlinearities are introduced via spatially dependent parameters in the lumped parameter equations. Thermal dependence may be added to accommodate for changing compliances, offsets, magnetic properties, etc. The model as shown extends upon the theoretically accepted small displacement model proposed by Thiele and Small. The model shown in FIG. 5*a* describes the eddy currents that occur at higher frequencies, more accurately than that proposed by Thiele and Small.

The terminal voltage is given by u(t), driver current by i(t) and coil displacement by x(t). The parameters Re, Bl(x), Cms(x), and Le(x) are dependent upon the coil displacement as well as the voice-coil temperature. The impedances represented by R2(x) and L2(x) may also be non-linear and of similar character to Le(x) but are generally influenced by different spectral aspects of the system (generally demonstrate significant nonlinearities in the higher frequency spectrum). In some simplifications, the functions R2 and L2 may be considered constant. The functions Bl(x), Cms(x) and Le(x) may be determined by a range of methods for the loudspeaker associated with a particular application. In general, the nonlinearities may be represented by temperature dependent polynomials, targeted functional representations or the like. For purposes of discussion, the functions Bl(x), Cms(x) and Le(x) were fitted using a known experimental method at room temperature.

For purposes of discussion, each of the functions were fitted to experimental data using polynomial functions. More realistic function fits may be implemented in order to maintain goodness of fit outside of the physically relevant range. Such extended goodness of fit may improve observer stability, adaptive algorithm stability, etc. in that such systems may temporarily extend into unrealistic conditions during the optimization and/or tracking process.

Many of the parameters may be temperature dependent. Some examples that are known to be affected by the voice-coil temperature when working in the large signal domain are considered to be Re, Bl(x), Cms(x) and Le(x).

The proposed equations may be put together into a general state-space form given by equation 21:

$$\dot{x} = \begin{bmatrix} 0 & 1 & 0 & 0 \\ \frac{-1}{MC_{ms}(x_1)} & \frac{-R_{ms}}{M} & \frac{Bl(x_1) + \frac{1}{2}\frac{dL_e(x_1)}{dx_1}x_3}{M} & \frac{\frac{1}{2}\frac{dL_2(x_1)}{dx_1}x_4}{M} \\ 0 & \frac{-Bl(x_1) - \frac{dL_2(x_1)}{dx_1}x_3}{L_e(x_1)} & \frac{-R_e(T_v) - R_2(x_1)}{L_e(x_1)} & \frac{R_2(x_1)}{L_e(x_1)} \\ 0 & 0 & \frac{R_2(x_1)}{L_2(x_1)} & \frac{-R_2(x_1) - \frac{dL_2(x_1)}{dx_1}x_2}{L_2(x_1)} \end{bmatrix} x + \begin{bmatrix} 0 \\ 0 \\ \frac{1}{L_e(x_1)} \\ 0 \end{bmatrix} u \quad \text{Equation 21}$$

The force factor Bl(x) is represented with a maximum value when the coil displacement is near to the resting value (zero). Alternative fitting functions may be employed to ensure all force factor values maintain are realistic.

The suspension compliance Cms(x) varies with temperature and may be subject to a range of nonlinear hysteretic effects as discussed herein.

The suspension impedance will increase when the cone leaves the equilibrium position, hence Cms(x) may be reduced outside the equilibrium. Thus the compliance and the force factor may share many of the same characteristics. In aspects, a suspension compliance function using Gaussian sums may be fitted to the experimental data for use in the nonlinear control system.

The voice-coil inductance Le(x) may have significant displacement dependency but does not generally share characteristics with the force factor and the suspension compliance. Generally speaking, the inductance will increase when the voice-coil moves inwards and decrease when it moves outwards. This is due to the magnetic field created by the current passing through the voice-coil. This function may further experience one or more hysteretic aspects discussed herein. In aspects, the voice-coil inductance may be fitted to experimental data using a series of Gaussian sums.

In aspects, the loudspeaker characteristics may be at least partially identified by monitoring the impedance thereof during a series of test procedures. Depending on the spectrum and amplitude of the input control signals, it may be possible to analyze the speaker over a range of different frequencies.

Figure 9:
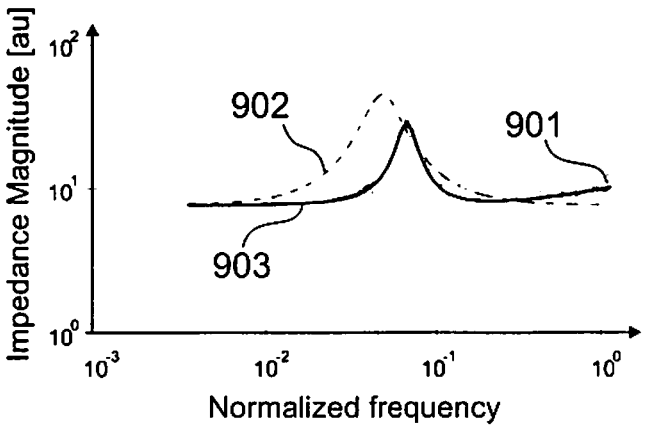
FIG. 9 shows the output of a method for fitting aspects of a nonlinear model in accordance with the present disclosure.

FIG. 9 shows an example of the information gleaned from this procedure, on a loudspeaker. In general the fundamental mode of the speaker cone (i.e. the fundamental resonant frequency), may be determined by using a chirp signal that starts as a low frequency sine wave and increases the frequency with time until it reaches a desired end frequency. The impedance may be calculated by capturing the driver output current and (optionally) voltage during such testing. An approximate function of the loudspeaker coil impedance may be acquired by linearization around the equilibrium point. The approximation is valid for small signals relating to small cone excursions. By using that, it is possible to match a measured impedance curve to it to calculate adequate starting speaker parameters.

In some instances, it may be advantageous to determine the effect of the driver(s) on performance of the system. Depending on the driver architecture, the driver may not be capable of delivering a DC current for example to the loudspeaker. Thus an associated nonlinear model may include an amplifier model, modeled as a high-pass filter. Nonlinear aspects may be added in order to improve the accuracy of the model.

FIG. 5*b* shows a lumped parameter model for a micro-electromechanical (MEMs) based transducer. The MEMs transducer may be part of a transducer array. The MEMs transducer functions based on electrostatic forces between closely placed electrodes (attached to a related diaphragm and backplate) in the structure of the transducer (e.g. generally across a narrow air gap). The MEMs transducer is complicated by various nonlinear phenomena including "pull-in" nonlinearities (and potential instabilities therein), nonlinear flow dynamics, and nonlinear damping characteristics. A model based on these phenomena may be included in a nonlinear control system associated with the performance enhancement of such devices.

The model shown in FIG. 5*b* highlights some features such as the acoustic radiation effects 514, the diaphragm dynamics 516 (e.g. including the nonlinearities associated with the gap capacitance), the backplate dynamics 518, airflow dynamics 520 through the air gap, and the acoustic properties of the back chamber 522. In this example, some of the equations may include significant humidity dependence along with spatial and temperature based dependence.

Such MEMs transducers may be designed as components in micropump systems, thus a control system as described herein may be applied to precision improvement and linearization of such associated micropumps.

Figure 6:
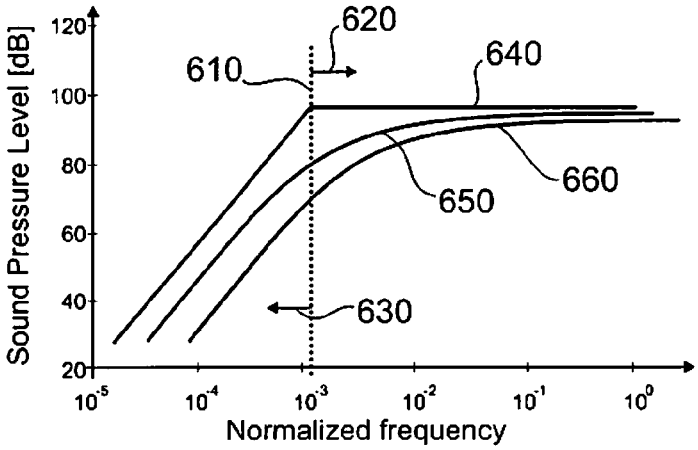
FIG. 6 shows a graphical description of a protection algorithm for use in a nonlinear control system in accordance with the present disclosure.

FIG. 6 shows a graphical description of a protection algorithm for use in a nonlinear control system in accordance with the present disclosure. The graph shows a protection envelop 640 as a function of frequency. The envelope 640 is designated to protect the audio system from different types of damage depending upon the frequency content of the associated control signals. Dividing line 610 generally indicates a transition between a high frequency domain dominated by thermal failure characteristics (designated by the arrow 620) and a low frequency domain whereby the loudspeaker performance is more likely dominated by excursion limitations (indicated by arrow 620). As the states are monitored or estimated within the nonlinear control system, a combination of the excursion, input spectrum, temperature, and/or power related aspects may be used to determine the operating point within the allowable space. A series of functions may be defined (i.e. represented graphically here by 650 and 660), whereby unconstrained operation below 660 may be prescribed, and smoothly limited performance may be enforced (perhaps by a compressor and/or protection block) as the operating points begin to approach the operating limits 640.

In aspects, the system may include a look a-head algorithm to predict movement of the operating point within such a domain, perhaps based upon a related thermal model, and/or via analysis of the streaming media signal. Such look a-head algorithms may be used to smoothly limit performance of the control system while avoiding performance glitches and pops, which may occur during rapid changes in controller gain, etc.

FIGS. 7*a-d* show aspects of multi-rate nonlinear control systems in accordance with the present disclosure.

Figure 7A:
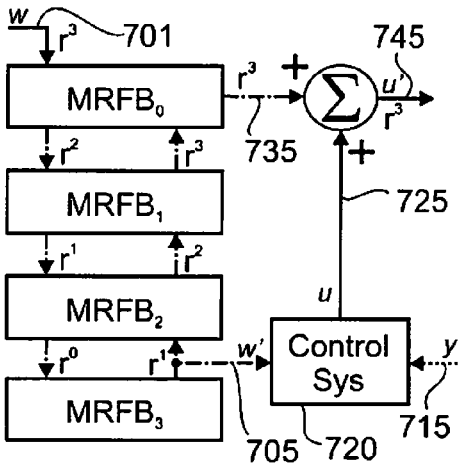
FIGS. 7*a-d* show aspects of non-limiting examples of multi-rate nonlinear control systems in accordance with the present disclosure.

FIG. 7*a* shows aspects of a multi-rate filter system including a nonlinear control system in accordance with the present disclosure. The multi-rate filter system includes a plurality of multi-rate filter blocks $MRFB_0$ to $MRFB_3$ each in accordance with the present disclosure. The multi-rate filter block $MRFB_0$ is connected to an input channel 701, configured so as to accept an input signal w, and is connected to an output channel, configured so as to output a filtered signal 735. Each multi-rate filter block includes an upsampler, a downsampler, and optionally a processing filter. The downsampler and upsampler in each multi-rate filter block $MRFB_i$ are configured with sampling ratios equal to "r". Such a limitation is only for illustration purposes. The sampling ratios may be configured to any values and need not be equal to each other.

The maximum frequency associated with each signal within the multi-rate filter system is indicated as a power of r (e.g. $r^n$). Thus the frequency spectrum associated with each multi-rate filters are logarithmically spaced across the entire signal spectrum. Such limitation is shown only for illustrative purposes. The sampling ratios may be configured to any unique values and need not be equal to each other.

The multi-rate filter system includes a nonlinear control system 720 in accordance with the present disclosure. The nonlinear control system 720 is connected to the bandcombiner output 705 of the multi-rate filter block $MRFB_3$. In the example shown, the bandcombiner output may be oversampled (i.e in this case to a value corresponding to the upper band limit of $r_1$). Thus there is sufficient spectral headroom in the bandcombiner output 705 to accommodate at least a portion of the distortion introduced by the nonlinear control system 720. The nonlinear control system 720 is configured to produce one or more control signals 725, which may be combined with the output of the multi-rate filter system (i.e. with the filtered output signal 735) to form a modified control signal 745 for delivery to one or more blocks within the system. In aspects, the sample rates of the summer inputs (the filtered output signal 735 and the control signal 725) are equivalent.

The nonlinear control system 720 may include a bass enhancement function in accordance with the present disclosure, perhaps included in a target dynamics block 306 in accordance with the present disclosure. In aspects, the nonlinear control system 720 may be equivalent to a nonlinear filter in accordance with the present disclosure.

Figure 7B:
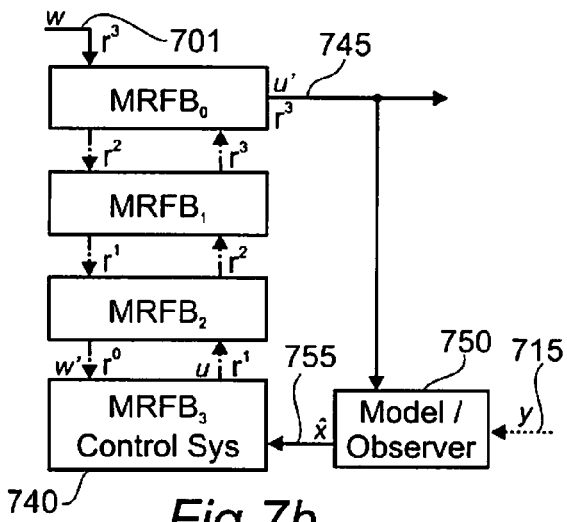

FIG. 7*b* shows aspects of a multi-rate filter system including a nonlinear control system in accordance with the present disclosure. The multi-rate filter system includes a plurality of multi-rate filter blocks $MRFB_0$ to $MRFB_3$ each in accordance with the present disclosure. The multi-rate filter block $MRFB_0$ is connected to an input channel 701, configured so as to accept an input signal w, and is connected to an output channel, configured so as to output one or more control signals 745. Each multi-rate filter block includes an upsampler, a downsampler, and optionally a processing filter. The downsampler and upsampler in each multi-rate filter block $MRFB_i$ are configured with sampling ratios equal to "r". Such a limitation is only for illustration purposes. The sampling ratios may be configured to any values and need not be equal to each other.

The maximum frequency associated with each signal within the multi-rate filter system is indicated as a power of r (e.g. $r^n$). Thus the frequency spectrum associated with each multi-rate filters are logarithmically spaced across the entire signal spectrum. Such limitation is shown only for illustrative purposes. The sampling ratios may be configured to any unique values and need not be equal to each other.

The multi-rate filter system includes a nonlinear control system 740 in accordance with the present disclosure. The nonlinear control system 740 may be directly integrated into the processing filters of the associated multi-rate filter block (in this case, the multi-rate filter block $MRFB_3$). The sampling rate of the associated filter block may be configured to capture sufficient harmonic content generated by the control system, so as to ensure that imaging and aliasing are substantially minimized. Thus, there is sufficient spectral headroom in the signal delivered to $MRFB_3$ to accommodate at least a portion of the distortion introduced by the nonlinear control system 740. The nonlinear control system 740 is configured to accept one or more states 755 from an associated model 750 in accordance with the present disclosure. The model 750 may include an observer and thus be configured to accept one or more feedback signals 715 and one or more control signals 745 for use in determining the states 755. Alternatively, additionally, or in combination, the model 30 may include a feed forward state estimator to calculate the states 755 (thus not necessarily requiring an associated feedback signal 715). The observer in the model 750 may be configured to operate at a significantly higher sample rate than the associated control system 740. This may be advantageous for capturing one or more key aspects of the system dynamics (e.g. a relevant resonant frequency, a sub-harmonic generator, etc.). Such an elevated sampling rate may also improve the stability of the observer algorithm.

The nonlinear control system 740 may include a bass enhancement function in accordance with the present disclosure, perhaps included in a target dynamics block 306 in accordance with the present disclosure. The nonlinear control system 740 may also be equivalent to a nonlinear filter in accordance with the present disclosure.

Figure 7C:
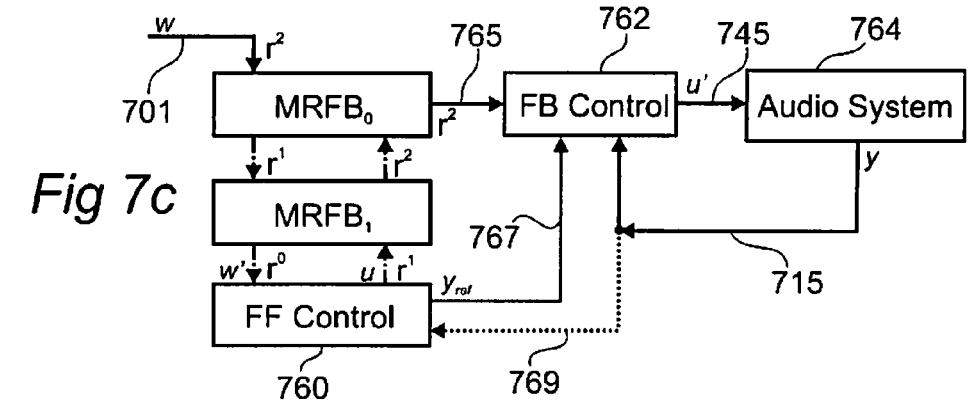

FIG. 7*c* shows aspects of a multi-rate filter system including a nonlinear control system in accordance with the present disclosure. The multi-rate filter system includes a plurality of multi-rate filter blocks $MRFB_0$ to $MRFB_2$ each in accordance with the present disclosure. The multi-rate filter block $MRFB_0$ is connected to an input channel 701, configured so as to accept an input signal w, and is connected to an output channel, configured so as to output one or more intermediate control signals 765. Each multi-rate filter block includes an upsampler, a downsampler, and optionally a processing filter. The downsampler and upsampler in each multi-rate fitter block $MRFB_i$ are configured with sampling ratios equal to "r". Such a limitation is only for purposes of illustration. The sampling ratios may be configured to any values and need not be equal to each other.

The multi-rate filter system includes a feed forward controller 760, a feedback controller 762 and an audio system 764, each in accordance with the present disclosure. The feed forward controller 760 may be directly integrated into the processing filters of the associated multi-rate filter block (in this case, the multi-rate filter block $MRFB_3$) and thus may include associated filters and an upsampler. The sampling rate of the associated filter block may be configured to capture sufficient harmonic content generated by the control system, so as to ensure that imaging and aliasing are substantially minimized. Thus, there is sufficient spectral headroom in the signal delivered to the feed forward controller 760 to accommodate at least a portion of the distortion introduced thereby. The feed forward controller 760 may be configured to produce one or more reference signals 767 and potentially to receive on or more feedback signals 769 (i.e. for protection purposes, to feed an observer, for comparison or adaptation purposes, etc.). The feedback controller 762 may be configured to accept one or more intermediate control signals 765, one or more reference signals 767, and one or more feedback signals 715 to produce one or more control signals 745. The audio system 764 may accept the control signals 762 and generate one or more feedback signals 715. This configuration may be advantageous as the feed forward controller may be calculated at a more computationally efficient sample rate while the feedback controller 762 may have an increased gain bandwidth product in order to more quickly address mismatches between the reference signals 767 and the feedback signals 715.

Figure 7D:
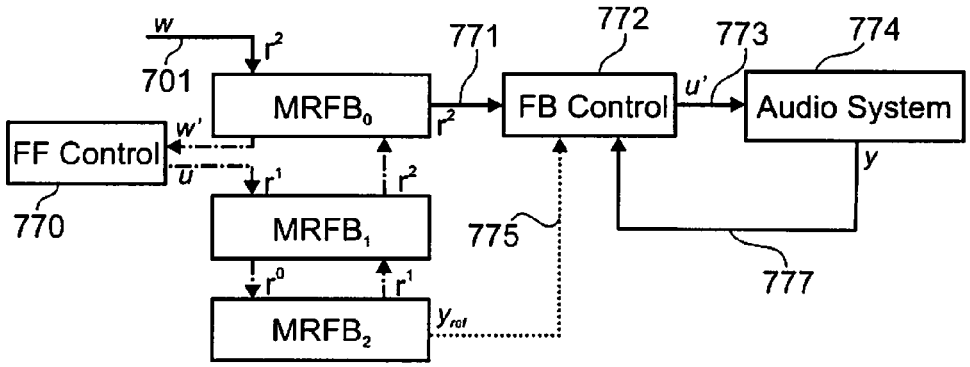

FIG. 7*d* shows aspects of a multi-rate filter system including a nonlinear control system in accordance with the present disclosure. The multi-rate filter system includes a plurality of multi-rate filter blocks $MRFB_0$ to $MRFB_2$ each in accordance with the present disclosure. The multi-rate filter block $MRFB_0$ is connected to an input channel 701, configured so as to accept an input signal w, and is connected to an output channel, configured so as to output one or more intermediate control signals 771. Each multi-rate filter block includes an upsampler, a downsampler, and optionally a processing filter. The downsampler and upsampler in each multi-rate filter block $MRFB_i$ are configured with sampling ratios equal to "r". Such a limitation is only provided for purposes of illustration. The sampling ratios may be configured to any values and need not be equal to each other.

The multi-rate filter system includes a feed forward controller 770, a feedback controller 772 and an audio system 774, each in accordance with the present disclosure. The feed forward controller 770 may be inserted between one or more multi-rate filter banks in the multi-rate filter cascade. In this example, the feed forward controller 770 is inserted between the output of $MRFB_0$ and $MRFB_1$. As shown in the FIG. 7*d*, the processing filter in one of the multi-rate filter banks (in this case $MRFB_2$) may be configured to provide one or more reference signals 775 for delivery to the feedback controller 772. The reference signals 775 may alternatively be provided directly by the feed forward controller 770. The feedback controller 772 may be configured to accept one or more intermediate control signals 771, one or more reference signals 775, and one or more feedback signals 777 to produce one or more control signals 773. The audio system 774 may accept the control signals 762 and generate one or more feedback signals 777. This configuration may be advantageous as the feed forward controller may be calculated at a more computationally efficient sample rate and the associated delay may be conveniently added into the multi-rate filter bank while the feedback controller 772 may be configured to operate with an increased gain bandwidth product in order to more responsively correct mismatches between the reference signals 775 and the feedback signals 777.

The feed forward controller 770 may include a bass enhancement function in accordance with the present disclosure, perhaps included in a target dynamics block 306 in accordance with the present disclosure. In aspects, the feed forward control system 770 may be substantially equivalent to a nonlinear filter in accordance with the present disclosure.

The structures shown may be advantageous for effectively coupling highly nonlinear functions into the cascade structure of the multi-rate filter system while retaining the computational advantages of the multi-rate configuration.

In related aspects, the multi-rate filter block cascade may be tapped at any bandcombiner output. Such taps may be used to construct wider band signals from the individual band signal of the multi-rate filter cascade.

In aspects, the sample rates of at least one downsampler and/or upsampler in the multi-rate filter system may be adaptively configurable. At least one downsampler and/or upsampler sample rate may be configured so as to coincide with an acoustic feature (e.g. an acoustic resonance, a bass band transition, a jitter, etc.) of an associated consumer electronics device into which the multi-rate filter system is included.

Figure 8:
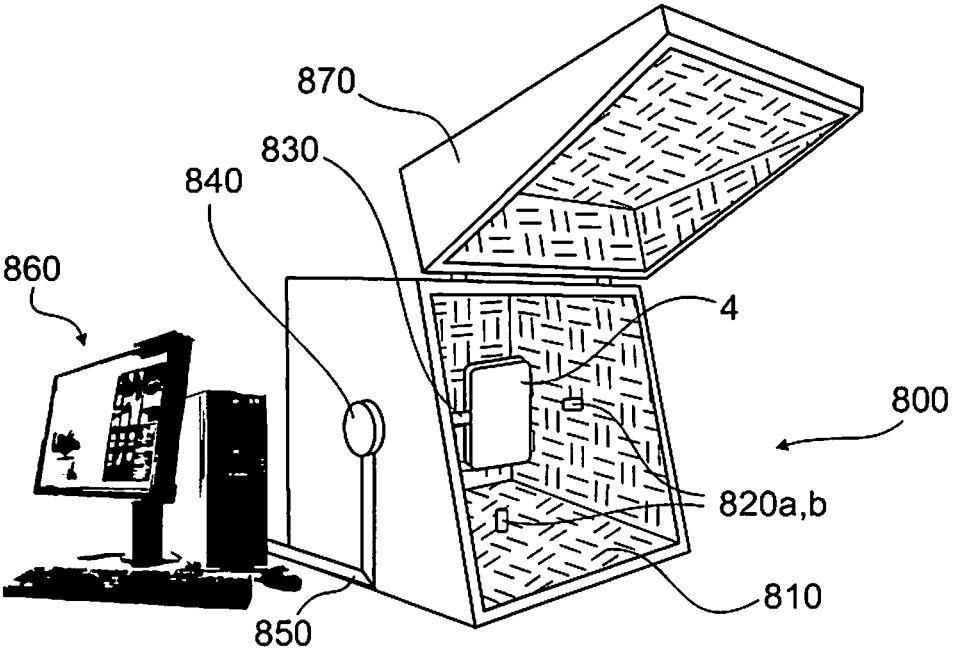
FIG. 8 shows a manufacturing unit for configuring a nonlinear control system on a consumer electronics device in accordance with the present disclosure.

FIG. 8 shows a manufacturing unit for configuring a nonlinear control system on a consumer electronics device in accordance with the present disclosure. The manufacturing unit includes a tuning rig 800 for testing, validating, programming, and/or updating a nonlinear control system within a consumer electronics device (CED) in accordance with the present disclosure. The tuning rig 800 may include an acoustic test chamber 810 (e.g. an anechoic chamber, semi-anechoic chamber, etc.) or alternatively a chamber with an improved acoustic quality (e.g. reduced echo, reduced influence from external sound sources, etc. compared to a manufacturing environment) in which to place a CED for testing. The tuning rig 800 may include and/or interface with an adaptive algorithm 410 in accordance with the present disclosure to perform the tuning and/or optimization process.

The tuning rig 800 may include one or more microphones 820*a,b* spaced within the acoustic test chamber 810 so as to operably obtain acoustic signals emitted from the CED 10 during a testing and optimization procedure. The tuning rig 800 may also include one or more characterization sensors, such as a laser displacement system (i.e. to assess cone movement during testing), a CCD camera (i.e. to assess component alignment, etc.), one or more thermal imaging cameras (i.e. to assess local temperature or heating patterns during testing, etc.), or the like. The tuning rig 800 may include a boom 830 for supporting the CED. The boom 830 may include a connector for communicating with the CED during a testing and optimization procedure (e.g. so as to send audio data streams to the CED for testing, to program control parameters to the nonlinear control system, etc.). The boom 830 may be connected to a mounting arm 840 on the wall of the acoustic test chamber 810. The mounting arm 840 may include a rotary mechanism for rotating the CED about the boom axis during a testing and optimization procedure. The mounting arm 840 may be electrically interconnected with a workstation 860 such as via cabling 850.

The workstation 860 is shown in the form of a computer workstation. Alternatively or in combination, the workstation 860 may include or be a customized hardware system. The hardware configuration of the workstation 860 may include a data collection front end, a hardware analysis block (e.g. part of an adaptive algorithm 410), and a programmer. Such a configuration may be advantageous for rapid, autonomous optimization one or more aspects of the associated nonlinear control system on the CED during manufacturing. The workstation 860 may include at least a portion of an adaptive algorithm 410 in accordance with the present disclosure.

The workstation 860 may have support for user input and/or output, for example to observe the programming processes, to observe the differences between batch programming results, for controlling the testing process, visualizing the design specification, etc. Alternatively or in combination, the workstation 860 may communicate audio test data and/or programming results to a cloud based data center. The cloud based data center may accept audio test data, compare with prior programming histories and/or the master design record/specification, and generate audio programming information to be sent to the CED. The cloud based data center may include an adaptive algorithm 410, a learning algorithm, etc. in accordance with the present disclosure.

The workstation 860 may communicate relevant audio streaming and program data with the CED wirelessly.

In aspects, the tuning rig 800 may be provided in a retail store or repair center to optimize the audio performance of a CED including a nonlinear control system in accordance with the present disclosure. In aspects of a fee for service implementation, a tuning rig 800 may be used in a retail store in order to optimize the audio performance of a customer's CED, perhaps after selection of a new case for their CED, at the time of purchase, during a service session, etc. Such systems may provide the discerning consumer with the option to upgrade the audio performance of their device and allow a retail center to offer a unique experience enhancing service for their consumers.

FIG. 9 shows the output of a method for fitting aspects of a nonlinear model in accordance with the present disclosure. The graph demonstrates an experimentally obtained signal impedance spectral response 901 obtained via a method in accordance with the present disclosure or any other known method, e.g. by mapping current and voltage measurements of any stimuli signal in different frequency regions over time by applying a moving band-pass filter or the like (shown as the dotted signal on the graph). The nonlinear state estimator associated with the loudspeaker under test is parametrically configured with an initial guess, resulting in an initial approximate impedance spectrum 902. The nonlinear state estimator or nonlinear model was then optimized based upon the measured spectral response 901. The optimized spectral response 903 is shown in the figure. As can be seen, the impedance spectrum of the loudspeaker was a useful input for optimizing the associated nonlinear model aspects of the nonlinear control system.

Based upon this approach, a method for optimizing a nonlinear model may include extracting the impedance spectrum of the loudspeaker during operation (e.g. perhaps during a test, during playback of a media stream, etc.). The impedance data may be used as a target to optimize one or more parameters of the associated nonlinear model. The resulting model parameters may be uploaded to the model after completion, or adjusted directly on the model during the optimization process.

In aspects, insufficient spectral content may be available in the general media stream. In such cases, audio watermarks may be added to the media stream to discreetly increase the spectral content and thus achieve the desired optimization (e.g. white noise, near white noise, noise shaped watermarks, etc. may be added).

Figure 10A:
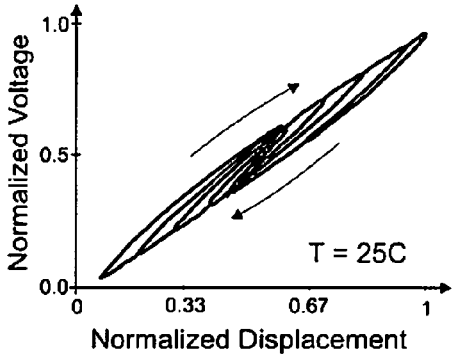
FIGS. 10*a-b* show aspects of nonlinear hysteresis models in accordance with the present disclosure.
Figure 10B:
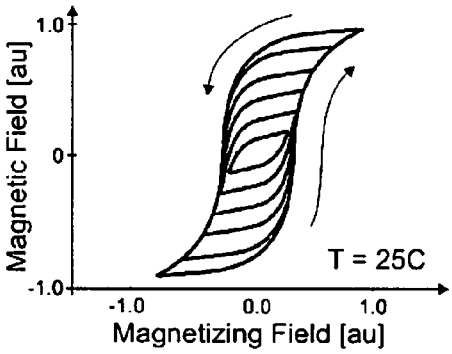

FIGS. 10*a-b* show aspects of nonlinear hysteresis models in accordance with the present disclosure. Large signal operation of transducers in accordance with the present disclosure may exhibit more complicated nonlinearities than considered previously. FIG. 10*a* shows an example of internal hysteresis loops associated with movement of a piezoelectric transducer during operation. FIG. 10*b* shows an example of hysteresis loops associated with magnetization of a magnetic field during operation. Such hysteretic effects may be temperature and aging dependent, as well as humidity dependent. Such effects are often related to inefficiency, complex distortion, etc. To compensate for such effects, the nonlinear system may include one or more higher order nonlinear hysteresis models. Some non-limiting examples of such models include Preisach models, Lipshin models, Bouc-Wen models, neural networks, fuzzy logic models, and the like. The models may be configured with sufficient complexity so as to capture the necessary dynamics without over complicating the computational aspects of the nonlinear control system. Such models may include thermal dependencies, rate dependencies (as opposed to being rate independent), etc.

In aspects, a nonlinear control system in accordance with the present disclosure may include a modified Bouc-Wen hysteresis model configured to compensate for the viscoelastic behavior of the suspension of the transducer included in the associated CED.

In aspects, a near time invariant Preisach model may be included into the loudspeaker model to capture loop hysteresis and nonlinearities in one or more nonlinear compensation blocks. The model may include temperature variation aspects thereof to further improve the model reliability and range of application.

Figure 11A:
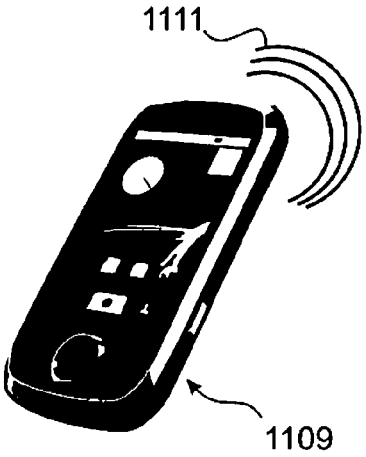
FIGS. 11*a-b* show a consumer electronics device and an integrated loudspeaker for use with a nonlinear control system in accordance with the present disclosure.
Figure 11B:
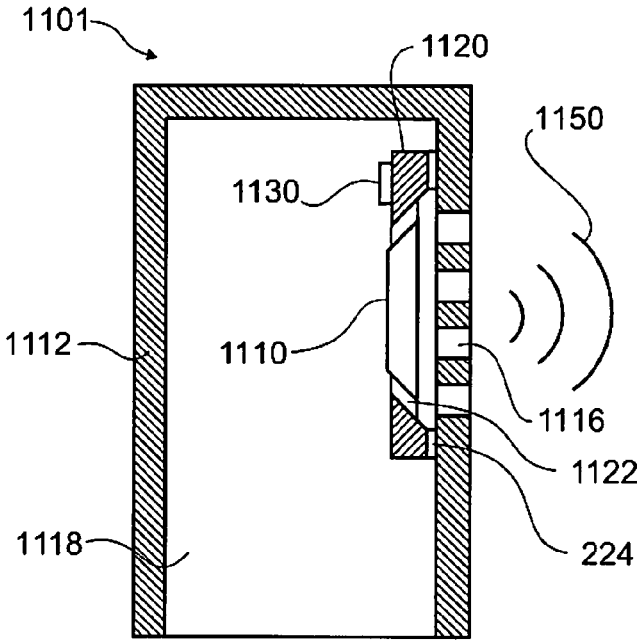

FIGS. 11*a-b* show a consumer electronics device and an integrated loudspeaker for use with a nonlinear control system in accordance with the present disclosure. FIG. 11*a* shows a consumer electronic device 1109 including a nonlinear control system in accordance with the present disclosure. The consumer electronic device 1109 (e.g. a smartphone) is configured to produce an audio output signal 1111. The CED 1109 may include an integrated loudspeaker assembly 1110 and/or a nonlinear control system, each in accordance with the present disclosure. The CED 1109 may be tested to determine an associated acoustic signature during the design process, the manufacturing process, the validation process, or the like, and the audio performance thereof adjusted through programming of the nonlinear control system included therein.

FIG. 11*b* shows an integrated loudspeaker assembly in a consumer electronic device (CED) 1101, 1109 in accordance with the present disclosure. The CED 1101, 1109 includes a casing 1112 and a plurality of perforations 1116 (or equivalent thereof) in the casing 1112, for providing fluid communication between the inside of the CED 1101 and a surrounding environment. The loudspeaker assembly includes a speaker unit 1110 and mounting support 1120. The speaker unit 1110 may be attached to the mounting support 1120 with a flexible support 1122. The mounting support 1120 may be attachable to the casing using a mounting adhesive 1124 or equivalent means of attachment (e.g. welding, glue bonding, screws, rivets, mechanical interconnections, etc.). The speaker unit 1110 may be configured to operably produce an audio output signal 1150.

The casing 1112 defines an enclosure 1118 into which additional device components (e.g. electrical components, mechanical components, assemblies, integrated loudspeaker assembly, etc.) may be placed.

The integrated loudspeaker assembly may be placed adjacent to the perforations 1116 such that the speaker unit 1110 separates the perforations 1116 from the rest of the enclosure 1118 of the CED 1101, 1109 (e.g. effectively forming an air-tight seal between the perforations 1116 and the rest of the enclosure 1118).

The integrated loudspeaker assembly may be provided without a well-defined back volume. Thus the back volume for the speaker unit 1110 may be at least partially shared with the rest of the enclosure 1118 of the CED 1101, 1109. Thus the back volume for the speaker unit 1110 is not defined until the integrated loudspeaker assembly is fully integrated into the final CED 1101, 1109 (e.g. along with all the other components that makeup the CED 1101, 1109). Such a configuration may be advantageous for increasing the available back volume for the speaker unit 1110, thus extending the overall bass range capabilities of the CED 1110. The speaker unit 1110 may further include a circuit 1130, the circuit 1130 including at least a portion of a nonlinear control system in accordance with the present disclosure.

In aspects, the circuit 1130 may be an ASIC or the like. Such a configuration may be advantageous for providing a fully compensated speaker unit 1110, optionally optimized to limit part to part variance, provide substantially maximal performance, etc. yet provide substantially no change in the assembly process for a device manufacturer, optimize for assembly mismatches, and/or compensate for connector impedance variance, and the like. Such a configuration may be advantageous to overcome contact resistance related issues experienced during loudspeaker assembly processes.

The speaker unit 1110 may include a voice coil, a spider, a cone, a dust cap, a frame, and/or one or more pole pieces as known to one skilled in the art.

The mounting support 1120 may be formed from a thermoplastic, a metal, etc. as known to one skilled in the art.

The integrated loudspeaker assembly may include electrical interconnects, driver, gasket, filters, audio enhancement chipsets (e.g. to form an active speaker), etc.

In aspects, the integrated loudspeaker assembly may include an audio amplifier (e.g. a class AB, class D amplifier, etc.), a crossover (e.g. a digital cross over, an active cross over, a passive crossover, etc.), and/or one or more aspects of a nonlinear control system in accordance with the present disclosure. The nonlinear control system may be configured to compensate for the back volume formed by the speaker unit 1110 and enclosure 1118 of the casing 1112, acoustic resonances of the casing 1112, acoustic contributions of the components and interconnection of components placed into the CED 1101, 1109, and the like.

Generally speaking, an observer in accordance with the present disclosure may be configured to operate under conditions of limited feedback. In such circumstances, the observer may be augmented with a suitable feed forward state estimator to assist with assessment of states with limited feedback.

An observer or non-linear model in accordance with the present disclosure may also be used to enhance robustness of a feedback system (e.g. used in parallel with a feedback controller) by providing additional virtual sensors. One non-limiting example may be the case where a measured state is too far off from the prediction made by the observer or model to be realistic and therefore being rejected as a faulty measurement. In the case of detection of a faulty measurement, the observer or model generated state estimation may be used instead of the direct measurement until valid measurements are produced again.

The nonlinear control system may be configured with real-time impedance based feedback, perhaps over a slower time period, to provide adaptive correction and/or update of parameters in the control system, e.g. to compensate for model variations due to aging, thermal changes or the like.

The nonlinear control system may include one or more stochastic models. The stochastic models may be configured to integrate a stochastic control method into the nonlinear control process. The nonlinear control system may be configured so as to shape the noise as measured in the system. Such noise shaping may be advantageous to adjust the noise floor to a higher frequency band for more computationally efficient removal during operation (e.g. via a simple low pass filter).

In aspects, the nonlinear control system includes a gain limiting feature, configured so as to prevent the control signal from deviating too far from the equivalent unregulated signal, so as to ensure stability thereof, limit THD, etc. This gain limiting aspect may be applied differently to different frequencies (e.g. allow more deviation at lower frequencies and less or even zero deviation at higher frequencies).

The state vector may be configured so as to include exact matched physical states such as membrane acceleration (a). In such a configuration, the accuracy of the position (x) and velocity (v) related states may be somewhat relaxed while maintaining a high precision match for the acceleration (a). Thus, DC drift of the membrane may be removed from the control output, preventing hard limiting of the membrane during operation.

A nonlinear control system in accordance with the present disclosure may include a simple analytical and/or black-box model of the amplifier behavior associated with one or more drivers. Such a model may be advantageous for removing artifacts from the control signal that may result in driver instability. One non-limiting example could be to model an AC amplifier as a high-pass filter with its corresponding cut-off frequency and filter slope.

In aspects, the nonlinear control system may include one or more "on-line" optimization algorithms. The optimization algorithm may be configured to continuously update one or more model parameters, perhaps during general media streaming. Such a configuration may be advantageous for reducing the effects of model faults over time while the system is in operation. In a laboratory and/or production setting, the optimization algorithm may afford additional state feedback from an associated kinematic sensor (e.g. laser displacement measurements of the cone movement) to more accurately fine tune the associated nonlinear model aspects of the system (e.g. feed-forward model parameters, observer parameters such as covariance matrices, PID parameters and the like). This approach may be advantageous to apply to the tuning rig 800 during manufacture of one or more CEDs including a nonlinear control system in accordance with the present disclosure. The system may be optimized while measuring as many states as practical. The associated multi-parameter optimization scheme may be configured to optimize to a minimum for the THD within the requested frequency range (e.g. for fundamentals up to 200 Hz).

The optimally configured model (e.g. configured during production), may be augmented with a parametrically adjustable model (e.g. a post-production adaptive control system). During the lifetime of the associated device, the parametrically adjustable model may be adaptively updated around the optimally configured model to maintain ideal operational characteristics. This configuration may be advantageous for improving the optimization results during the lifetime of the device, adaptively mapping the model parameters while knowing all states (i.e. by laser or accelerometers) or alternatively by measuring the THD with a microphone and optimize with that as a minimizing target and/or to simply implement the impedance curve mapping according to any associated method in accordance with the present disclosure.

The optimally configured and parametrically adjustable approach may be suitable for removing various aspects of the model that can cause instability or bimodal response with a "black-box" representation thereof (i.e. where the input-to-output characteristics are somewhat blindly mapped).

The optimally configured and parametrically adjustable approach may be advantageous as it may provide a means for matching an entire product line with a single adaptable model, or for matching different types of speakers more easily as the need for a perfect model is relaxed. The configuration may be amendable to implementation with an API, laboratory and/or manufacturing tool kit. The system may also be used to characterize optimally configurable (and complex) models for different speaker types (e.g. electro-active polymers, piezo-electric, electrostrictive and other types of electro-acoustic transducers [where a simple model is not a valid description of the system]) while employing a black box model for adaptive correction in the field (i.e. via implementation of one or more automatic control and/or adaptation processes described herein).

In aspects, a feed-forward controller in accordance with the present disclosure may be assisted by a PID controller, perhaps included in an associated feedback controller (to compensate for variations in the feed forward model output). Such a configuration may be less computationally intensive than alternative approaches while providing a simplified implementation. Although reference is made to PID, other forms of control may be used, as disclosed herein.

One or more aspects of the nonlinear control system may be implemented digitally. In one non limiting example, the nonlinear control system is implemented in an entirely digital fashion.

In aspects, the model parameters may be optimized in a lab setting, where full state feedback is possible. In this example, a method may include determining a small-signal measurement of equivalent Thiele-Small parameters (linear), making a rough guess to the nonlinear parameter shapes, measuring a large-signal stimuli to determine one or more large signal characteristics, adjust the model parameters until the output states of the model substantially match the measured states. Such a method may be implemented using a trusted region optimization method or the like. The process may also be implemented iteratively with a plurality of measurements or with a range of stimuli.

The method may include setting one or more model parameters (e.g. configuring a covariance matrix) of the controllers target dynamics and/or inverting dynamics aspects by any known technique. In aspects, the setting may be achieved by a brute-force approach including testing all possible regulator parameters within reasonable intervals to find the settings for minimum THD. The minimum THD can then be measured on the real system and simulated by the model and used to correct for changes experienced by the device in the field. This approach may also be done iteratively while measuring the actual THD in each measurement iteration.

The method may include configuring the PID-parameters. Such configuring may be achieved by, for example, a "brute-force" approach or the like, whereby all possible values within reasonable limits are tested while measuring the THD of the speaker and searching for a minimum. In this case, it may be preferable to measure the THD as opposed to simulating it.

Such a method may include measuring the impedance in accordance with the present disclosure. If real-time impedance measurements demonstrate a parameter mismatch severely (e.g. via severe changes in temperature or ageing), the system may automatically use the new impedance curve to map the nonlinear model to the new system in real-time. Thus a technique for continuously and dynamically adapting model parameters may be provided during system operation. Small model variations may be compensated for by a linear feedback system (e.g. a PID controller).

Such an approach may be performed in real-time. When a reliable impedance curve is obtained during measurement, the parameter adaptation (e.g by trusted region optimization) may be performed. As temperature or aging may occur relatively slowly compared with the system dynamics, such an adaptation approach may run occasionally, whenever the processor is "free" and does not suffer from real-time requirements on a sample rate basis.

The enclosure model may be provided in a closed or vented configuration so as to match the implementation in question.

In aspects, a nonlinear control system including an observer (e.g. an EKF, UKF, AUKF, or the like) in accordance with the present disclosure, may include an adaptive algorithm for adjusting one or more model parameters "on-line". The observer may then be optimized or trained to adapt to updated model parameters while operating in the field.

In accordance with the present disclosure, the controller may be divided into "Target Dynamics" (corresponding to the target behavior, e.g. a linear behavior) and "Inverse Dynamics" (which is basically aiming to cancel out all dynamics of the un-controlled system, including non-linearities) aspects. In this case, the target dynamics portion may include one or more nonlinear effects, such as psycho-acoustic non-linearities, a compressor, or any other "target" behavior. Thus the controller may merge the nonlinear compensation aspects with the enhanced audio performance aspects.

A nonlinear control system may be configured to work on primarily a low frequency spectrum (e.g. less than 1000 Hz, less than 500 Hz, less than 200 Hz, less than 80 Hz, less than 60 Hz, etc.). In one non-limiting application, the nonlinear control system may be configured to operate on a modified input signal. In this case, the input signal may be divided within the woofer band with another crossover (e.g. at 80 Hz). The modified input signal delivered to the nonlinear control system may be focused only on the band below the crossover. Additional aspects are discussed throughout the disclosure.

A nonlinear control system in accordance with the present disclosure may be embedded in an application specific integrated circuit (ASIC) or be provided as a hardware descriptive language block (e.g. VHDL, Verilog, etc.) for integration into a system on chip (SoC), an application specific integrated circuit (ASIC), a field programmable gate array (FPGA), or a digital signal processor (DSP) integrated circuit.

Alternatively, additionally, or in combination, one or more aspects of the nonlinear control system system may be soft-coded into a processor, flash, EEPROM, memory location, or the like. Such a configuration may be used to implement the nonlinear control system at least partially in software, as a routine on a DSP, a processor, and ASIC, etc.

It will be appreciated that additional advantages and modifications will readily occur to those skilled in the art. Therefore, the disclosures presented herein and broader aspects thereof are not limited to the specific details and representative embodiments shown and described herein. Accordingly, many modifications, equivalents, and improvements may be included without departing from the spirit or scope of the general inventive concept as defined by the appended claims and their equivalents.

What is claimed is:

1. A nonlinear control system for producing a rendered audio stream from one or more input signals, the nonlinear control system comprising:

a controller configured to accept the one or more input signals, and one or more estimated states, and to generate one or more control signals therefrom;

a model configured to accept the one or more control signals and generate the one or more estimated states therefrom; and an audio system comprising at least one transducer, the audio system configured to accept the one or more control signals and to drive the transducer with the one or more control signals or a signal generated therefrom to produce the rendered audio stream, wherein the controller comprises a protection block configured to analyze the one or more input signals, the one or more estimated states and/or the one or more control signals and to modify the one or more control signals based upon the analysis.

2. The nonlinear control system in accordance with claim 1, wherein the model comprises a feed forward nonlinear state estimator configured to generate the one or more estimated states.

3. The nonlinear control system in accordance with claim 1, wherein the model comprises an observer and the audio system comprises a means for producing one or more feedback signals, and wherein the observer is configured to accept the one or more feedback signals or signals generated therefrom and to generate the one or more estimated states from the one or more feedback signals and the one or more control signals.

4. The nonlinear control system in accordance with claim 1, wherein the audio system comprises a driver configured to interconnect the one or more control signals with the transducer, to monitor one or more of a current signal, a voltage signal, a power signal, and/or a transducer impedance signal, and to provide a feedback signal to one or more components of the nonlinear control system.

5. The nonlinear control system in accordance with claim 1, wherein the audio system comprises a feedback coordination block configured to accept one or more sensory signals generated by one or more sensors, transducers, in the nonlinear control system and to generate one or more feedback signals therefrom.

6. The nonlinear control system in accordance with claim 1, wherein the nonlinear control system is integrated into a consumer electronics device selected from the group consisting of a smartphone, a tablet computer, and a soundbar.

7. The nonlinear control system in accordance with claim 1, wherein the transducer is selected from the group consisting of an electromagnetic loudspeaker, a piezoelectric actuator, an electroactive polymer based loudspeaker, and an electrostatic loudspeaker.

8. A consumer electronics device comprising the nonlinear control system in accordance with claim 1.

9. A nonlinear control system for producing a rendered audio stream from one or more input signals, the nonlinear control system comprising:

a controller configured to accept the one or more input signals, and one or more estimated states, and to generate one or more control signals therefrom;

a model configured to accept the one or more control signals and generate the one or more estimated states therefrom; and an audio system comprising at least one transducer, the audio system configured to accept the one or more control signals and to drive the transducer with the one or more control signals or a signal generated therefrom to produce the rendered audio stream, wherein the model comprises an observer and the audio system comprises a means for producing one or more feedback signals, wherein the observer is configured to accept the one or more feedback signals or signals generated therefrom and to generate the one or more estimated states from the one or more feedback signals and the one or more control signals, and wherein the observer comprises an unscented Kalman filter or an augmented unscented Kalman filter to generate the one or more estimated states.

10. The nonlinear control system in accordance with claim 9, wherein the model comprises a feed forward nonlinear state estimator, configured to generate the one or more estimated states.

11. The nonlinear control system in accordance with claim 9, wherein the audio system comprises a driver configured to interconnect the one or more control signals with the transducer, to monitor one or more of a current signal, a voltage signal, a power signal, and/or a transducer impedance signal, and to provide a feedback signal to one or more components of the nonlinear control system.

12. A nonlinear control system for producing a rendered audio stream from one or more input signals, the nonlinear control system comprising:

a controller configured to accept the one or more input signals, and one or more estimated states, and to generate one or more control signals therefrom;

a model configured to accept the one or more control signals and generate the one or more estimated states therefrom; and an audio system comprising at least one transducer, the audio system configured to accept the one or more control signals and to drive the transducer with the one or more control signals or a signal generated therefrom to produce the rendered audio stream, wherein the model comprises an observer and the audio system comprises a means for producing one or more feedback signals, wherein the observer is configured to accept the one or more feedback signals or signals generated therefrom and to generate the one or more estimated states from the one or more feedback signals and the one or more control signals, and wherein the controller comprises a feed forward control system interconnected with a feedback control system, the model is configured to generate one or more reference signals from the one or more estimated states, the feed forward control system is configured to perform a nonlinear transformation on the one or more input signals to produce an intermediate control signal, and the feedback control system is configured to compare two or more of the intermediate control signals, the one or more reference signals, and the one or more feedback signals to generate the one or more control signals.

13. The nonlinear control system in accordance with claim 12, wherein the feed forward control system comprises a PID control block and an exact input-output linearization controller.

14. The nonlinear control system in accordance with claim 12, wherein the audio system comprises a driver configured to interconnect the one or more control signals with the transducer, the driver configured to monitor one or more of a current signal, a voltage signal, a power signal, and/or a transducer impedance signal, and to provide a feedback signal to one or more components of the nonlinear control system.

15. The nonlinear control system in accordance with claim 12, wherein the audio system comprises a feedback coordination block configured to accept one or more sensory signals generated by one or more sensors, transducers, in the nonlinear control system and to generate one or more feedback signals therefrom.

16. A nonlinear control system for producing a rendered audio stream from one or more input signals, the nonlinear control system comprising:

a controller configured to accept the one or more input signals, and one or more estimated states, and to generate one or more control signals therefrom;

a model configured to accept the one or more control signals and generate the one or more estimated states therefrom; and an audio system comprising at least one transducer, the audio system configured to accept the one or more control signals and to drive the transducer with the one or more control signals or a signal generated therefrom to produce the rendered audio stream, wherein the controller includes a target dynamics block and an inverse dynamics block, the target dynamics block is configured to modify the one or more input signals or a signal generated therefrom to generate a targeted spectral response therefrom, and the inverse dynamics block is configured to compensate for one or more nonlinear property of the audio system on the one or more input signals or a signal generated therefrom.

17. The nonlinear control system in accordance with claim 16, wherein the target dynamics block and the inverse dynamics block are serially interconnected.

18. The nonlinear control system in accordance with claim 16, wherein the audio system comprises a driver configured to interconnect the one or more control signals with the transducer, to monitor one or more of a current signal, a voltage signal, a power signal, and/or a transducer impedance signal, and to provide a feedback signal to one or more components of the nonlinear control system.

19. A nonlinear control system for producing a rendered audio stream from one or more input signals, the nonlinear control system comprising:

a controller configured to accept the one or more input signals, and one or more estimated states, and to generate one or more control signals therefrom;

a model configured to accept the one or more control signals and generate the one or more estimated states therefrom;

an audio system comprising at least one transducer, the audio system configured to accept the one or more control signals and to drive the transducer with the one or more control signals or a signal generated therefrom to produce the rendered audio stream; and an adaptive algorithm configured to monitor a distortion aspect of one or more signals within the nonlinear control system and to modify one or more aspects of the controller to reduce the distortion aspect.

20. The nonlinear control system in accordance with claim 19, wherein the controller comprises one or more parametrically defined parameters, a function of the controller being dependent on the one or more parametrically defined parameters, and wherein the adaptive algorithm is further configured to adjust the one or more parametrically defined parameters to reduce the distortion aspect.

21. The nonlinear control system in accordance with claim 19, wherein the audio system comprises a driver configured to interconnect the one or more control signals with the transducer, to monitor one or more of a current signal, a voltage signal, a power signal, and/or a transducer impedance signal, and to provide a feedback signal to one or more components of the nonlinear control system.

22. A nonlinear control system for producing a rendered audio stream from one or more input signals, the nonlinear control system comprising:

a controller configured to accept the one or more input signals, and one or more estimated states, and to generate one or more control signals therefrom;

a model configured to accept the one or more control signals and generate the one or more estimated states therefrom; and an audio system comprising at least one transducer, the audio system being configured to accept the one or more control signals and to drive the transducer with the one or more control signals or a signal generated therefrom to produce the rendered audio stream, wherein the audio system comprises a means for estimating a characteristic temperature of the transducer and delivering characteristic temperature estimate to one or more of the controller and/or the model, the controller and/or the model being configured to compensate for changes in the characteristic temperature estimate.

23. The nonlinear control system in accordance with claim 22, wherein the audio system comprises a driver configured to interconnect the one or more control signals with the transducer, to monitor one or more of a current signal, a voltage signal, a power signal, and/or a transducer impedance signal, and to provide a feedback signal to one or more components of the nonlinear control system.

24. The nonlinear control system in accordance with claim 22, wherein the audio system comprises a feedback coordination block configured to accept one or more sensory signals generated by one or more sensors, transducers, in the nonlinear control system and to generate one or more feedback signals therefrom.

25. The nonlinear control system in accordance with claim 22, wherein the nonlinear control system is integrated into a consumer electronics device selected from the group consisting of a smartphone, a tablet computer, and a soundbar.

26. The nonlinear control system in accordance with claim 22, wherein the transducer is selected from the group consisting of an electromagnetic loudspeaker, a piezoelectric actuator, an electroactive polymer based loudspeaker, and an electrostatic loudspeaker.

27. A method for matching performance of a production speaker to a target speaker model, the method comprising:

configuring the production speaker with a nonlinear control system including:

a controller configured to accept one or more input signals, and one or more estimated states, and to generate one or more control signals therefrom;

a model configured to accept the one or more control signals and generate the one or more estimated states therefrom; and an audio system comprising at least one transducer, the audio system configured to accept the one or more control signals and to drive the transducer with the one or more control signals or a signal generated therefrom to produce a rendered audio stream;

analyzing the performance of the production speaker;

comparing the performance of the production speaker to performance of the target speaker model; and adjusting the nonlinear control system to modify the performance of the production speaker to substantially match the performance of the target speaker model.

28. The method in accordance with claim 27, further comprising iteratively performing the steps of analyzing, comparing, and adjusting.

29. The method in accordance with claim 27, wherein the step of adjusting is at least partially performed with an unscented Kalman filter.

* * * * *